US008015934B2

(12) United States Patent
Hanada

(10) Patent No.: US 8,015,934 B2
(45) Date of Patent: Sep. 13, 2011

(54) THREAD CUTTING DEVICE OF SEWING MACHINE

(75) Inventor: Tsuyoshi Hanada, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 413 days.

(21) Appl. No.: 12/389,013

(22) Filed: Feb. 19, 2009

(65) Prior Publication Data

US 2009/0211505 A1 Aug. 27, 2009

(30) Foreign Application Priority Data

Feb. 21, 2008 (JP) ..... 2008-040024

(51) Int. Cl.
*D05B 65/00* (2006.01)

(52) U.S. Cl. ..... 112/292; 112/185

(58) Field of Classification Search ..... 112/285, 112/286, 287, 288, 289, 290, 291, 292, 293, 112/294, 295, 296, 297, 298, 299, 300, 301, 112/302; 83/910
See application file for complete search history.

(56) References Cited

U.S. PATENT DOCUMENTS 3,554,149 A * 1/1971 Diehm et al. ..... 112/287
4,365,568 A * 12/1982 Ross ..... 112/291
5,722,338 A * 3/1998 Douyasu ..... 112/475.17
5,964,170 A * 10/1999 Gries ..... 112/291
7,603,957 B2 * 10/2009 Shiraishi ..... 112/298
7,926,434 B2 * 4/2011 Hanada ..... 112/292
2008/0250995 A1 * 10/2008 Hanada ..... 112/285
2009/0211505 A1 * 8/2009 Hanada ..... 112/292

FOREIGN PATENT DOCUMENTS

JP 3106472 11/2000

* cited by examiner

*Primary Examiner* — Danny Worrell
*Assistant Examiner* — Larry Worrell, Jr.
(74) *Attorney, Agent, or Firm* — Drinker Biddle & Reath LLP

(57) ABSTRACT

A thread cutting device of a sewing machine is provided. The thread cutting device cuts a thread extending between a horizontal shuttle and a throat plate of the sewing machine. The thread cutting device includes a fixed blade, a first thread catcher, a second thread catcher, a driving assembly which moves the first and second thread catchers such that the first thread catcher catches the thread before the second thread catcher catches the thread and pulls the thread toward the fixed blade to cut the thread, and a guide member disposed between the first thread catcher and the driving assembly. The guide member guides the first thread catcher from an advanced position to a thread catching position to catch the thread, and further guides the first thread catcher from the thread catching position to a standby position to turn the first thread catcher toward the fixed blade.

3 Claims, 22 Drawing Sheets

THREAD CUTTING DEVICE OF SEWING MACHINE

CROSS-REFERENCE TO RELATED APPLICATION

The present application claims priority from Japanese Patent Application No. 2008-040024 filed on Feb. 21, 2008, the entire content of which is incorporated herein by reference.

FIELD OF THE INVENTION

The present invention relates to a thread cutting device of a sewing machine which cuts a thread by catching the thread using a thread catcher and guiding the thread toward a fixed blade.

DESCRIPTION OF RELATED ART

As shown in FIG. 22A, a related-art thread cutting device is provided, for example, in a domestic sewing machine having a horizontal shuttle 240 (see, e.g., JP 3106472 B2). The thread cutting device includes a thread catcher 610 which moves back and forth using a power obtained from a lower shaft which is driven by a sewing machine motor. As shown in FIG. 22B, during the backward movement of the thread catcher 610, the thread catcher 610 catches a lower thread T using a forked thread catching portion at the tip end of the thread catcher 610 and guides the lower thread T toward a fixed blade to cut the lower thread T.

In view of beautiful finishing and improving efficiency of post-processing, it is preferable that residual lengths of upper and lower threads on a side of a cloth be short as possible after being cut.

In contrast, in order to reliably lock the threads together in the subsequent sewing operation, a certain mount of residual lengths of the threads are required on a side of a sewing machine after being cut.

However, as shown in FIG. 23, when cutting the lower thread with the thread catcher 610 and the fixed blade of the related art thread cutting device so as to ensure the required residual length L1 of the lower thread on the side of the sewing machine, the residual length L2 of the lower thread on the side of the cloth becomes undesirably long.

SUMMARY OF THE INVENTION

It is an object of the present invention to provide a thread cutting device of a sewing machine which can cut a thread to have an appropriate residual length.

According to an aspect of the present invention, a thread cutting device of a sewing machine is provided. The sewing machine includes a needle which moves up and down, a throat plate formed with a needle hole through which the needle passes, and a horizontal shuttle which rotates below the throat plate to form a stitch in cooperation with the needle, wherein the thread cutting device is configured to cut a thread extending between the horizontal shuttle and the needle hole. The thread cutting device includes a fixed blade, a first thread catcher configured to catch the thread, a second thread catcher configured to catch the thread and to pull the thread toward the fixed blade to cut the thread, a driving assembly configured to move the first thread catcher and the second thread catcher such that the first thread catcher catches the thread before the second thread catcher catches and pulls the thread, and a guide member disposed between the first thread catcher and the driving assembly. The guide member is configured to guide the first thread catcher from an advanced position to a thread catching position at which the first thread catcher catches the thread, and to further guide the first thread catcher from the thread catching position to a standby position to turn the first thread catcher toward the fixed blade.

Other aspects and advantages of the invention will be apparent from the following description, the drawings and the claims.

DETAILED DESCRIPTION

Figure 1:
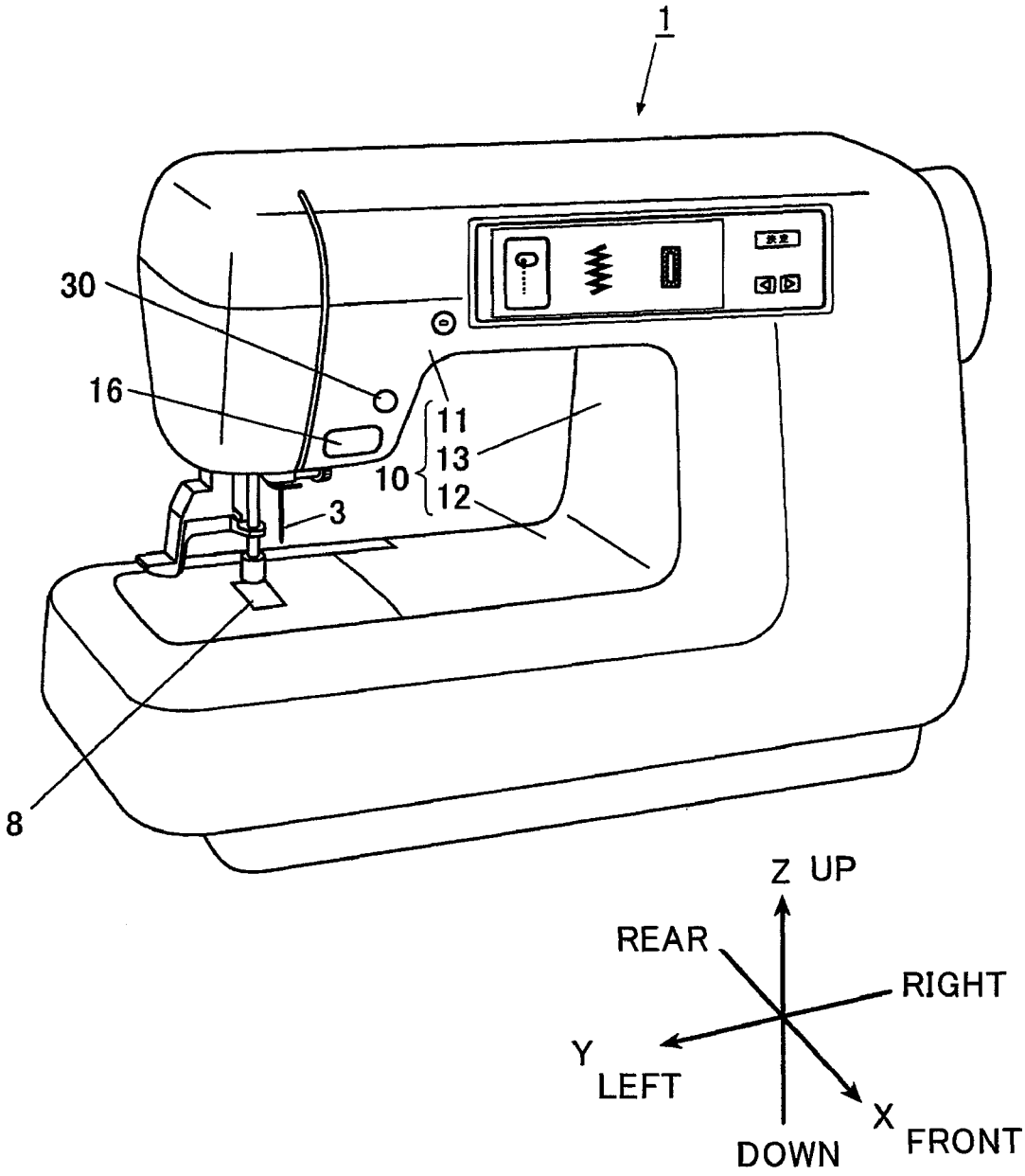
FIG. 1 is a schematic perspective view of a sewing machine according to an embodiment of the present invention.

Hereinafter, embodiments of the present invention will be described in detail with reference to the drawings. The following embodiments do not limit the scope of the present invention.

In the following description, orientations of respective components of a sewing machine will be defined based on X, Y, and Z axes indicated in the drawings. In a state in which the sewing machine is placed on a horizontal plane, the Z-axis direction is an up-and-down direction along the vertical direction, the Y-axis direction is a right-and-left direction along which an arm portion of the sewing machine extends, and the X-axis direction is a front-and-rear direction which is horizontal and orthogonal to the Y-axis direction.

A sewing machine 1 according to an embodiment of the present invention is a domestic sewing machine which forms pattern stitches on a cloth by forwardly or rearwardly feeding the cloth along a cloth feeding direction while swinging a needle 3 in a direction orthogonal to the cloth feeding direction.

The sewing machine 1 includes a thread cutting device 100 (see FIGS. 2 and 3) which cuts a thread, a sewing machine frame 10 inside which the thread cutting device 100 is accommodated, a needle driving mechanism which is provided inside the sewing machine frame 10 to move the needle 3 up and down, a shuttle mechanism 20 (see FIG. 3) which cooperates with the needle driving mechanism to form the stitches, a sewing machine motor 5 (see FIG. 5) which rotates a main shaft to serve as a driving source of the up-and-down movement of the needle 3, an encoder 6 (see FIG. 9) which detects a rotation amount of the sewing machine motor 5, a thread cutting start switch 30 which actuates the thread cutting device 100, a main shaft position detection sensor 7 (see FIG. 9) which detects a certain position (e.g., an upper position) on a circumference of the main shaft, and a controller 50 (see FIG. 9) which controls an operation of the sewing machine motor 5.

The sewing machine 1 further includes a start-stop switch 16 from which start and stop of the sewing operation of the sewing machine 1 is input, a pattern selecting switch 17 from which a pattern to be sewn is selected, a speed setting portion 18 from which a stitching speed is set, a needle bar swinging stepping motor 90 serving as a drive source of the needle swinging, a feed dog driving stepping motor 91 serving as a drive source of the cloth feeding, and a selected pattern display 92 (e.g., a liquid crystal display panel) which displays a selected pattern to be sewn.

As shown in FIG. 1, the sewing machine frame 10 includes an arm portion 11 which forms an upper portion of the sewing machine frame 10, a bed portion 12 which forms a lower portion of the sewing machine frame 10 and extending in parallel to the arm portion 11, and a vertical drum portion 13 which couples the arm portion 11 and the bed portion 12 and extending in the up-and-down direction (the Z-axis direction) orthogonal to the longitudinal directions of the arm portion 11 and the bed portion 12, so that the sewing machine frame 10 has a reversed-C shape in a front view.

Inside the arm portion 11, an upper shaft (not shown) serving as the main shaft is rotatably provided along the Y-axis direction, i.e. along the longitudinal direction of the arm portion 11, and the sewing machine motor 5 is coupled to the upper shaft to serve as the main driving source of the sewing machine operations. A thread cutting start switch 30, from which a start of a thread cutting operation of the thread cutting device 100 is input, is provided on the operator-side face of the tip end portion of the arm portion 11.

Inside the bed portion 12, a lower shaft 2 is rotatably provided along the longitudinal direction of the bed portion 12, i.e. along the Y-axis direction. The lower shaft 2 is coupled to the upper shaft via pulleys and a belt. That is, when the upper shaft is rotated the sewing machine motor 5, the lower shaft 2 is rotated via the pulleys and the belt. According to this embodiment, the rotational speed of the upper shaft and the rotational speed of the lower shaft 2 are the same so that the rotational angle of the upper shaft and the rotational angle of the lower shaft 2 correspond to each other. That is, the rotational angle of the lower shaft 2 is detectable by detecting the rotational angle of the upper shaft. A throat plate 8 is disposed on a tip end portion of the bed portion 12 along an upper surface portion of the bed portion 12. The throat plate 8 is formed with a needle hole 9 through which the needle 3 penetrates during its up-and-down movement.

The needle driving mechanism includes a rotor spindle (not shown) fixed to the tip end of the upper shaft inside the tip end portion of the arm portion 11, a crank rod (not shown) rotatably coupled to an eccentric portion of the rotor spindle, a needle bar coupled to a lower end of the crank rod, and the needle 3 supported at a lower end portion of the needle bar. When the upper shaft is rotated by the sewing machine motor 5, up and down movements are transmitted to the needle bar through the rotor spindle and the crank rod, whereby the needle 3 reciprocates along the up-and-down direction.

Figure 3:
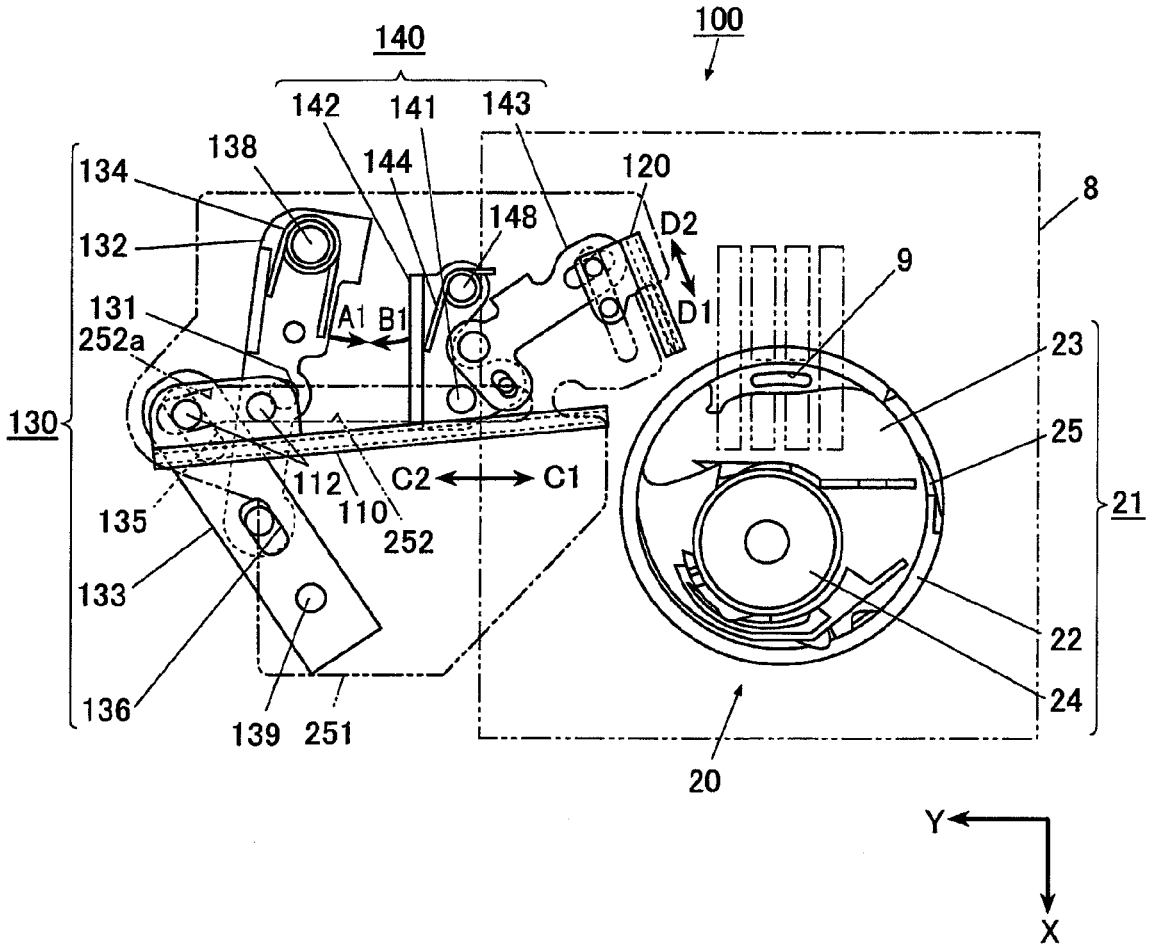
FIG. 3 is a plan view of the thread cutting device.

As shown in FIG. 3, the shuttle mechanism 20 is disposed inside the tip end portion of the bed portion 12 and near a stitching point at which the needle 3 is moved down by the needle driving mechanism. The shuttle mechanism 20 includes a horizontal shuttle 21 which rotates around a shuttle shaft (not shown) vertically extending along the Z-axis direction. The horizontal shuttle 21 includes an outer shuttle 22 which rotates by obtaining a power from the lower shaft 2 via a shuttle shaft gear (not shown), and an inner shuttle 23 which does not rotate and is disposed inside of the outer shuttle 22. The outer shuttle 22 rotates at a rotational speed which is twice as high as the rotational speed of the upper shaft and the lower shaft 2, i.e. the outer shuttle 22 rotates twice during a single rotation of the lower shaft 2. The outer shuttle 22 has a hook 25 at an outer circumferential portion thereof. The hook 25 catches a loop of an upper thread which is formed inside the bed portion 12 when the needle 3 is moved up. Inside the inner shuttle 23, a bobbin 24 around which a lower thread is wound is rotatably and replaceably attached. The upper side of the horizontal shuttle 21 is opened to supply the lower thread from the bobbin 24. The lower thread and the upper thread are locked together to form a stitch.

Figure 2:
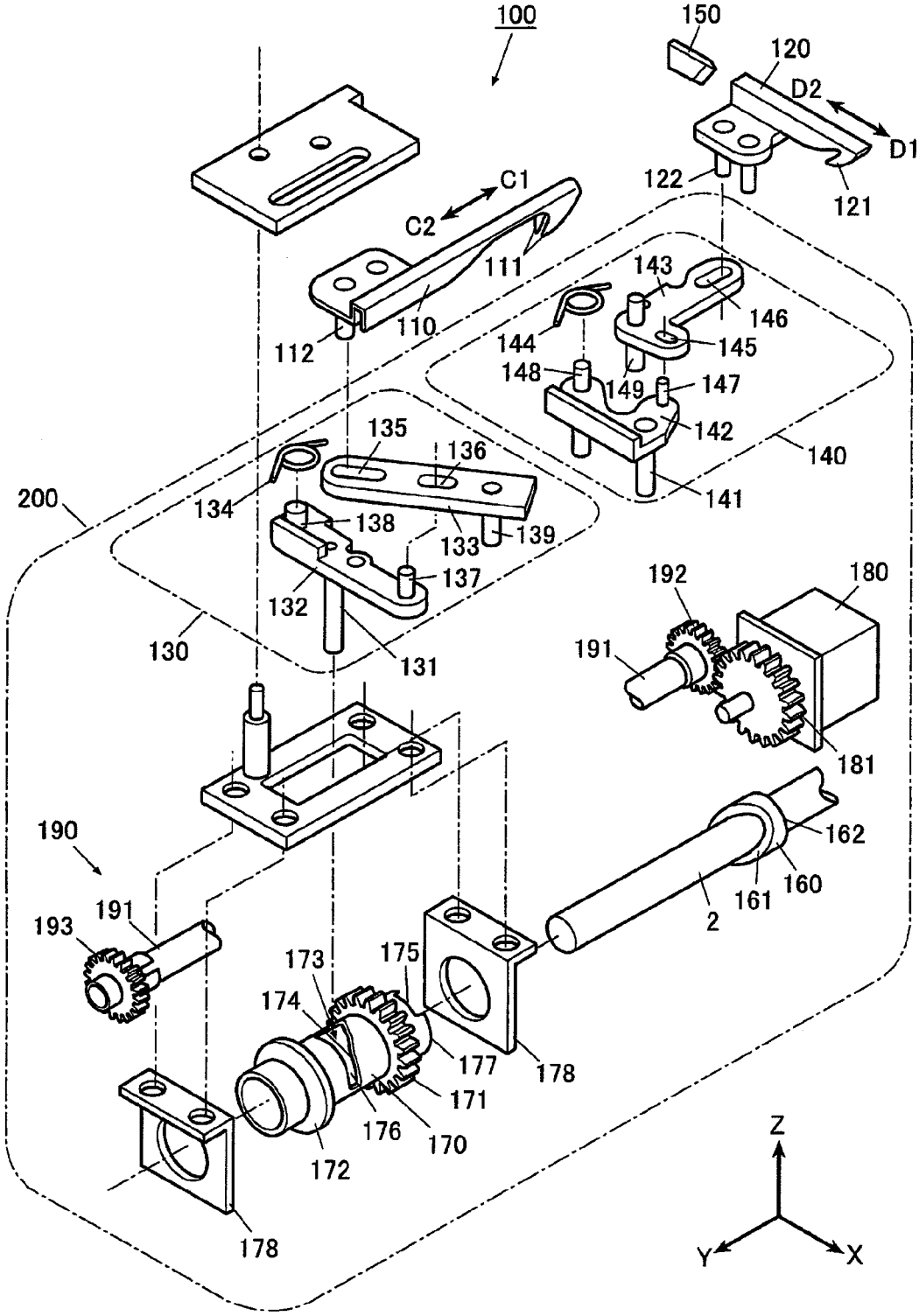
FIG. 2 is an exploded perspective view of a thread cutting device of the sewing machine.

As shown in FIG. 2, the thread cutting device 100 cuts at least one of the upper thread and the lower thread existing between the horizontal shuttle 21 and the needle hole 9. The thread cutting device 100 includes a first thread catcher 110 which moves back and forth below the throat plate 8 to catch the thread, a second thread catcher 120 which catches the thread extending between the needle hole 9 and the first catching portion 111 and guides the thread to the fixed blade 15 to cut the thread, and a driving assembly 200 which is configured to drive the second thread catcher 120 to perform the catching operation and the cutting operation after the catching operation of the first thread catcher 110.

Figure 4A:
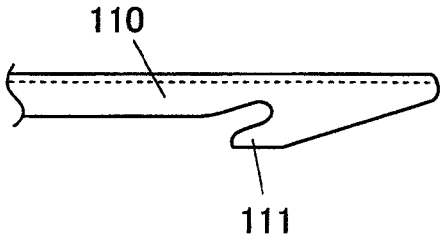
FIG. 4A is a partial side view of a first thread catcher.

As shown in FIG. 2 and FIG. 4A, the first thread catcher 110 has, on its tip end portion, a first catching portion 111 having a hook-shape which is bent toward the back side C2 in its back and forth movement. The first thread catcher 110 catches the thread T with the first thread catching portion 111 by moving back and forth (a linear reciprocation) in the longitudinal direction of the lower shaft 2 (i.e. in a Y-axis direction) along a guide slot 252 of a guide mechanism 250 which will be described later. The first thread catcher 110 is moved by a first link mechanism 130 of the driving assembly 200. While the first thread catching portion 111 is forked in this embodiment (see FIG. 2), it may be formed as a single hook. Alongside the first thread catcher 110, a clamp member (a thread holding member) is provided. When the first thread catcher 110 is at its initial position, i.e., at the most retracted position, the clamp member is brought into contact with a side surface of the first catching portion 111 and holds the thread T that has been cut. A base end portion of the first thread catcher 110 is formed with two pins 112 (a support portion) extending substantially orthogonal to a direction in which the first thread catcher 110 extends. The two pins 112 are supported by the first link mechanism 130.

Likewise, the second thread catcher 120 has, on its tip end portion, a second catching portion 121 having a hook-shape which is bent toward the back side D2 in its back and forth movement. The second thread catcher 120 catches the thread T extending between the first catching portion 111 of the first thread catcher 110 and the needle hole 9 (see FIG. 20). The second thread catcher 120 is arranged at a position near the stitching point where the second catching portion 121 can intersect, in a plan view, with the thread T extending between the first catching portion 111 of the first thread catcher 110 and the needle hole 9 by moving back and forth (a linear reciprocation) the along a second guide slot 300 of the guide mechanism 250 which will be described later. The second thread catcher 120 is driven by a second link mechanism 140 of the driving assembly 200.

Figure 4B:
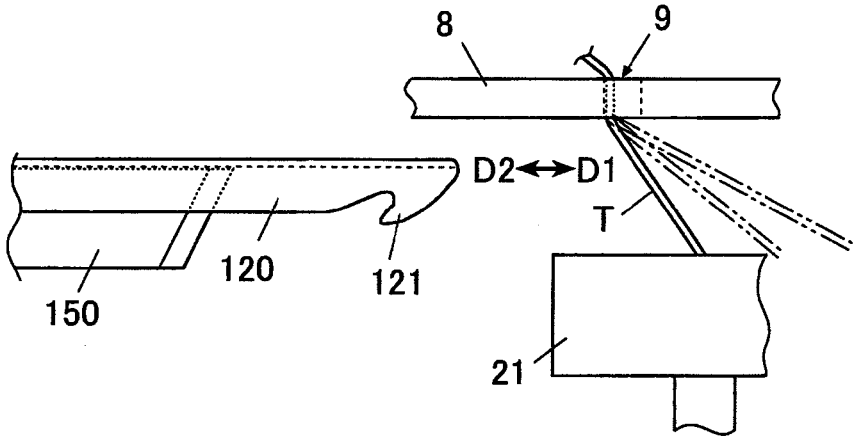
FIG. 4B is a schematic view illustrating a heightwise relationship among a second thread catcher, a fixed blade, a throat plate, a horizontal shuttle and a thread.

As shown in FIG. 4B, the second thread catcher 120 is disposed at a height at which the second catching portion 121 can catch the thread T extending between the first catching portion 111 of the first thread catcher 110 and the needle hole 9. More specifically, a front end of the second thread catcher 120 is upwardly sharpened toward the throat plate 8, and this front end moves to pass a region between the first catching portion 111 of the first thread catcher 110 and the throat plate 8.

Figure 4C:
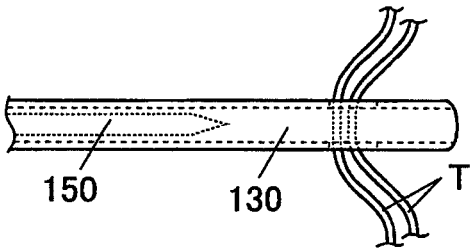
FIG. 4C is a plan view of the second thread catcher and the fixed blade.

The second thread catcher 120, including the second catching portion 121, is formed with a forked portion downwardly extending in parallel along the longitudinal direction of the second thread catcher 120 (see FIGS. 3 and 4C). The fixed blade 150 is arranged on an inner side of this forked portion such that its blade tip is oriented in an advancing direction of the second thread catcher 120 (see FIGS. 4B and 4C). The second thread catcher 120 is moved back and forth by the driving assembly 200 to perform the linear reciprocation along the fixed blade 150, thereby guiding the thread T, which has been caught by the second catching portion 121, toward the fixed blade 150 to cut the thread T.

As shown in FIG. 2, the driving assembly 200 includes a stepping motor 180 serving as a drive source of the catching movement of the first thread catcher 110, a first cam 160 (a thread cutting cam) provided on the lower shaft 2 which is rotated by the sewing machine motor 5, a second cam 170 (a thread catcher drive cam) which is provided in parallel with the first cam 160 and driven by the stepping motor 180, the first link mechanism 130 having a first cam follower 131 which can contact drivers of the first cam 160 and the second cam 170 and transmitting a power for the back and forth movement to the first thread catcher 110 from the first cam 160 and the second cam 170, and the second link mechanism 140 having a second cam follower 141 which can contact the drivers the first cam 160 and the second cam 170 and transmitting a power for the back and forth movement to the second thread catcher 120 from the first cam 160 and the second cam 170.

Figure 5:
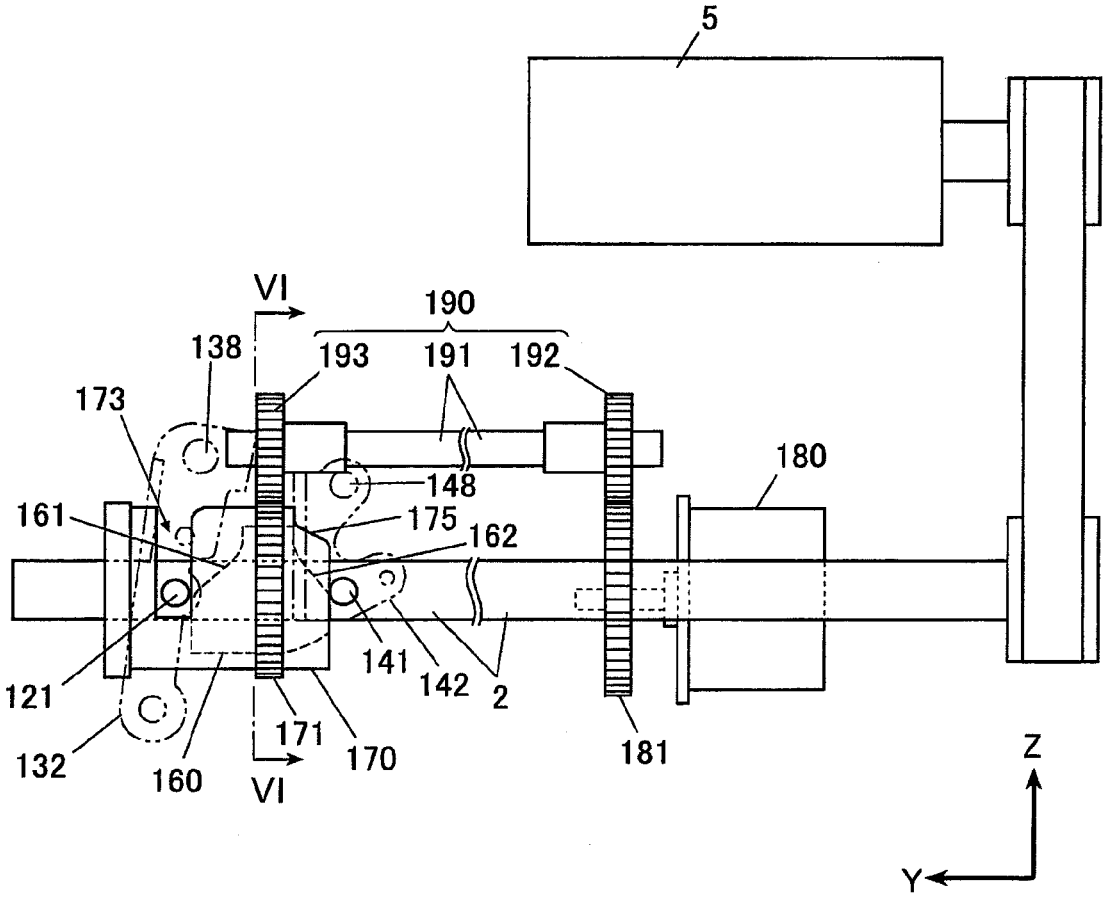
FIG. 5 is a schematic view of some components of the thread cutting device.

As shown in FIGS. 2 and 5, the stepping motor 180 is placed inside the bed portion 12 at a position on a side of the vertical drum portion 13 (the right side in FIG. 5) and is arranged such that an output shaft thereof extends along the Y-axis direction. One end of a torque transmission shaft 191 extending parallel to the lower shaft 2 is coupled to the output shaft of the stepping motor 180 via gears 181, 192, and another gear 193 is provided on the other end of the torque transmission shaft 191. When the stepping motor 180 is driven, a torque is imparted to the second cam 170 through a power transmission mechanism 190 including the gears 181, 192, the torque transmission shaft 191 and the gear 193.

Figure 7:
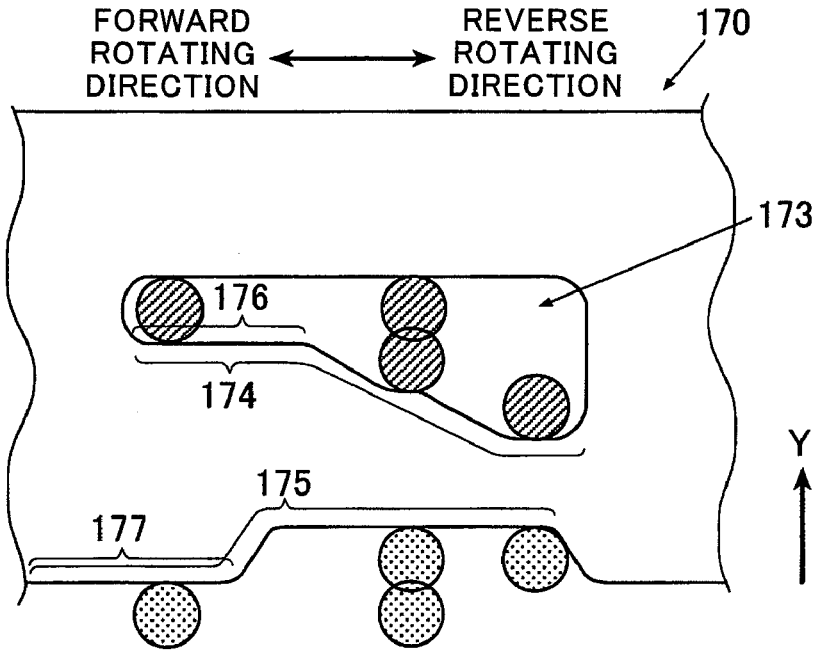
FIG. 7 is a development view illustrating a configuration of a thread cutting cam.

In this embodiment, the second cam 170 is rotated to move the first thread catcher 110 and the second thread catcher 120 in their respective advancing directions C1, D1 when the stepping motor 180 is rotated in a forward rotating direction, and the second cam 170 is rotated to move the first thread catcher 110 and the second thread catcher 120 in their respective retracting directions C2, D2 when the stepping motor 180 is rotated in a reverse rotating direction (see FIG. 7).

In accordance with the axial rotations of the second cam 170, the first thread catcher 110 is moved back and forth via the first link mechanism 130 and the second thread catcher 120 is moved back and forth via the second link mechanism 140. A driving amount of the stepping motor 180 corresponding to an axial rotation amount the second cam 170 is empirically obtained in advance as pulse numbers corresponding to various back and forth moving distances, and are stored in a ROM 52 which is a storage unit of the controller 50.

The first cam 160 is an end cam which is fixed to the lower shaft 2 and is rotatable with the lower shaft 2. The first cam 160 has drivers on both end faces in the axial direction of the lower shaft 2, i.e. in the Y-axis direction. An end face of the first cam 160 (the left end face in FIG. 5) on a retracting side in the back and forth movement of the first thread catcher 110, i.e. on a tip end side of the bed portion 12 is configured as an end cam portion 161 which engages with the first cam follower 131 of the first link mechanism 130. The other end face (the right end face in FIG. 5) on a side of the vertical drum portion 13 inside the bed portion 12 is configured as another end cam portion 162 which engages with the second cam follower 141 of the second link mechanism 140.

When driven by the sewing machine motor 5, the end cam portions 161, 162 of the first cam 160 guides the cam followers 131, 141 such that the first thread catcher 110 which has caught the thread T is retracted to the most retracted position while keeping the second thread catcher 120 positioned at the most advanced position, and such that the second thread catcher 120 is retracted to its most retracted position thereafter.

Figure 8:
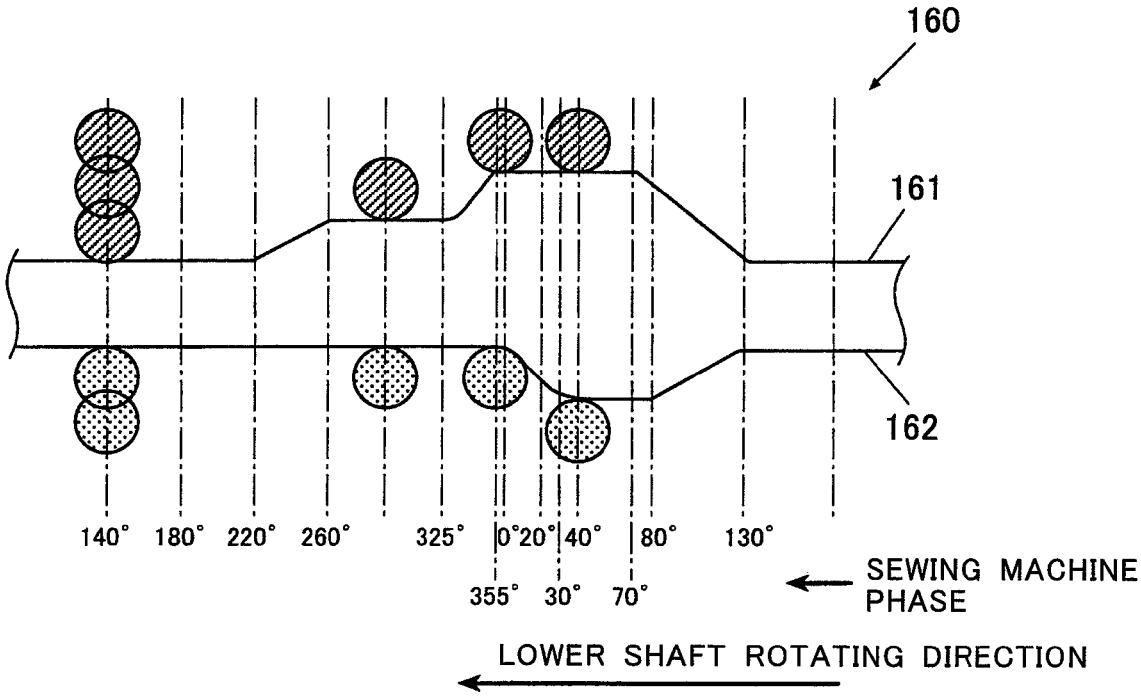
FIG. 8 is a development view illustrating a configuration of a thread catcher driving cam.

More specifically, end face shapes of the respective end cam portions 161, 162 are curved in a stepwise manner in accordance with respective phases in the rotating direction of the lower shaft 2 (see FIG. 8) so as to guide the cam followers 131, 141 at appropriate timings and with appropriate moving amounts depending on the rotational amount of the lower shaft 2 which is rotated by the sewing machine motor 5 in accordance with the controller 50.

Figure 6:
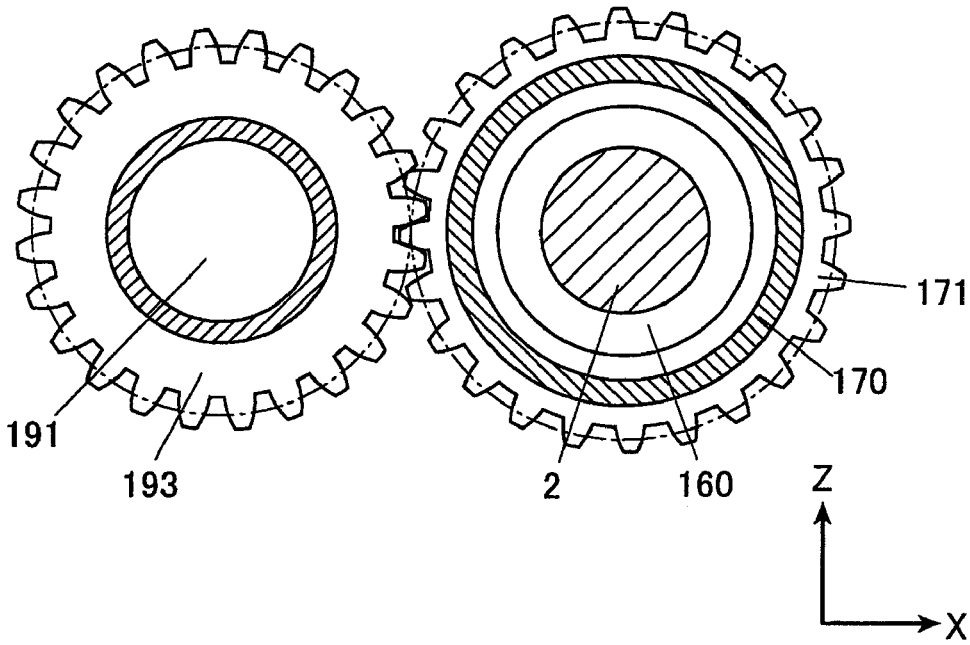
FIG. 6 is a sectional view taken along the line VI-VI of FIG. 5.

The second cam 170 is a cylindrical cam which is arranged such that its axial direction is along the Y-axis direction. The second cam 170 is arranged such that it is concentric with the first cam 160 fixed to the lower shaft 2 to accommodate the first cam 160 thereinside. That is, as shown in FIGS. 5 and 6, the first cam 160 fixed to the lower shaft 2 is rotatably inserted inside the second cam 170 together with the lower shaft 2.

A gear 171 and a flange 172 are provided on the outer peripheral portion of the second cam 170 near the respective end portions in the axial direction of the second cam 170. The gear 171 and the flange 172 are brought into contact with respective support members 178 which rotatably support the second cam 170, thereby positioning the second cam 170 with respect to the axial direction. The gear 171 is a driven gear which transmits a rotational force from the stepping motor 180 to the second cam 170.

The second cam 170 is formed with an opening 173 which penetrates through a part of the peripheral surface of the second cam 170. As shown in FIG. 7, an end face of the opening 173 on a side of the gear 171 (a lower side in FIG. 7) is opened in an expanded manner so as to become closer to the gear 171 toward one end side in the circumferential direction of the second cam 171, i.e., toward the reverse rotating direction of the stepping motor 180 (toward the right in FIG. 7). This end face of the opening 173 is configured as a circumferential cam portion 174 having a diagonal portion which is formed to incline with respect to the X-axis direction and the Y-axis direction.

When the second cam 170 is rotated around the Y-axis, the circumferential cam portion 74 moves the first cam follower 131 in the Y-axis direction, while the first cam follower 131 is brought into contact with the circumferential cam portion 174 by a biasing force of a spring 134. The circumferential cam portion 174 has a standby portion 176 formed along the circumferential direction orthogonal to the axial direction of the second cam 170, on the forward rotation side of the stepping motor 180 (the left side in FIG. 7). When the first cam follower 131 of the first link mechanism 130 engages with the standby portion 176, the first thread catcher 110 is positioned at a standby position (see FIG. 13B) which is the most retracted position in its back and forth movement. More specifically, the standby portion 176 moves the first thread catcher 110 backward and moves the first cam follower 131 to a position at which the end cam portion 161 of the first cam 160 and the first cam follower 131 of the first link mechanism 130 are disengaged from each other, and holds the first cam follower 131 at this position. In other words, when the first cam follower 131 is held at the standby portion 176 so that the first thread catcher 110 is positioned at the standby position (see FIG. 13B), the lower shaft 2 and the first cam 160 can freely rotate without being disturbed.

On the other hand, similar to the circumferential cam portion 174, the end cam portion 175 moves the second thread catcher 120 backward to the most retracted position via the second link mechanism 140 and moves the second cam follower 141 to a position at which the end cam portion 162 of the first cam 160 and the second cam follower 141 of the second link mechanism 140 are disengaged from each other, and holds the second cam follower at this position. That is, when the second cam follower 141 is arranged at the standby portion 177 which is formed along the circumferential direction orthogonal to the axial direction and the second thread catcher 120 is arranged at the standby position (see FIG. 13B), the second cam follower 141 and the first cam 160 are disengaged from each other (see FIG. 13A), so that the lower shaft 2 and the first cam 160 can freely rotate without being disturbed.

In other words, the circumferential cam portion 174 and the end cam portion 175 of the second cam 170 are configured to retract the first thread catcher 110 and the second thread catcher 120 and to move and hold the cam followers 131, 141 at the positions at which the driver of the first cam 160 is disengaged from both of the cam followers 131, 141.

Further, the circumferential cam portion 174 and the end cam portion 175 of the second cam 170 move the first thread catcher 110 and the second thread catcher 120 from their most retracted positions to most advanced positions by forward rotation of the stepping motor 180, and then guide the cam followers 131, 141 by reverse rotation of the stepping motor 180 such that the first thread catcher 110 is positioned at a thread catching position which is on the way back to the most retracted position while maintaining the second thread catcher 12 at the most advanced position (see FIG. 7).

As shown in FIGS. 2 and 3, the first link mechanism 130 includes a link 132 whose one end is rotatably supported on a base (not shown) which is fixed inside the bed portion 12, a link 133 which is rotatably coupled to the other end portion of the link 132, and a spring 134 which biases the link 132 toward one rotating direction.

One end of the link 132 is supported on a side to the second cam 170 by a pivot 138 whose axial center is in the Z-axis direction, and the other end of the link 132 is horizontally extended above the second cam 170 and is provided so as to be horizontally rotatable around the pivot 138. The rod-shaped first cam follower 131 is extended downward from a central portion in the longitudinal direction of the link 132. The first cam follower 131 has a lower end inserted into the opening 173 of the second cam 170, and contactable with both the circumferential cam 174 of the second cam 170 and the end cam portion 161 of the first cam 160. From the other end of the link 132, a pin 137 is upwardly protruded.

At a central portion in the longitudinal direction of the link 133, a slot 136 which penetrates the link 133 in the Z-axis direction is formed along the longitudinal direction. The link 133 is rotatably coupled to the link 132 via a pin 137 which is slidably fitted in the slot 136. One end of the link 133 on the opposite side of the pivot 138 of the link 132 across the coupling portion to the link 132 is supported on the base (not shown) fixed inside the bed portion 12 rotatably around a pivot 139 along the Z-axis direction so that the link 133 can turn horizontally. At the other end of the link 133, a slot 135 which penetrates the link 133 in the Z-axis direction along the longitudinal direction is formed, and in the slot 135, the pins 112 provided at a lower portion of the first thread catcher 110 is slidably engaged.

The spring 134 biases the link 132 so as to rotate the link 132 in the direction A1 shown in FIG. 3. In other words, by biasing the first cam follower 131 extending below the link 132 toward the circumferential cam portion 174 and the end cam portion 161 side, the spring 134 biases the first thread catcher 110 coupled to the link 132 via the link 133 in the advancing direction C1, i.e. in the rightward direction in FIG. 3.

The first link mechanism 130 transmits a moving force in the advancing direction C1 (the rightward direction in FIGS. 3 and 5) to the first thread catcher 110 by an biasing force of the spring 134, and when the first cam 160 or the second cam 170 rotates and the first cam follower 131 is moved to the tip end side of the bed portion 12 (the left side in FIGS. 3 and 5) against the biasing force of the spring 134, the first link mechanism transmits a moving force in the retracting direction C2 to the first thread catcher 110.

As shown in FIGS. 2 and 3, the second link mechanism 140 includes a link 142 whose one end is axially supported so as to horizontally turn at a position closer to the stitching point than the first link mechanism 130, a link 143 coupled to the other end of the link 142, and a spring 144 which biases the link 142 toward one rotating direction B1.

The link 142 has a substantially L shape, and one end thereof is supported so as to horizontally rotate around a pivot 148 along the Z-axis direction. The other end of the link 142 is horizontally extended toward a region above the lower shaft 2 and is horizontally rotatable (see FIG. 5). At the other end of the link 142, a pin 147 is provided to protrude upward, and the rod-shaped second cam follower 141 is provided to extend downward. The lower end of the second cam follower 141 is extended to the vicinity of the lower shaft 2 and is contactable with both of the end cam portion 175 of the second cam 170 and the end cam portion 162 of the first cam 160.

The link 143 has a substantially L shape, and is supported at a bent portion of the L shape so as to horizontally rotate around a pivot 149 along the Z-axis direction. At one end of the shorter side of the link 143, a slot 145 extending along a radial direction of the pivot 149 is formed to penetrate the link 143 in the Z-axis direction. The link 143 is rotatably coupled to the link 142 via a pin 147 slidably inserted through the slot 145. At the other end of the longer side of the link 143, a slot 143*a* extending along a radial direction of the pivot 149 is formed to penetrate the link 143 in the Z-axis direction. In the slot 143*a*, a pin 122 provided on the lower portion of the second thread catcher 120 is slidably engaged.

The spring 144 biases the link 142 such that the link 142 rotates in the direction B1 shown in FIG. 3. In other words, the spring 144 biases the second cam follower 141 provided at the lower end of the link 142 toward the end cam portion 145 and the end cam portion 162 side, and biases the second thread catcher 120 coupled to the link 142 via the link 143 in the advancing direction D1.

The second link mechanism 140 transmits a moving force in the advancing direction D1 to the second thread catcher 120 by the biasing force of the spring 144, and when the first cam 160 or the second cam 170 rotates and the second cam follower 141 is moved to the vertical drum portion 13 side (to the right in FIGS. 3 and 5) against the biasing force of the spring 144, the second link mechanism transmits a moving force in the retracting direction D2 to the second thread catcher 120.

Figure 9:
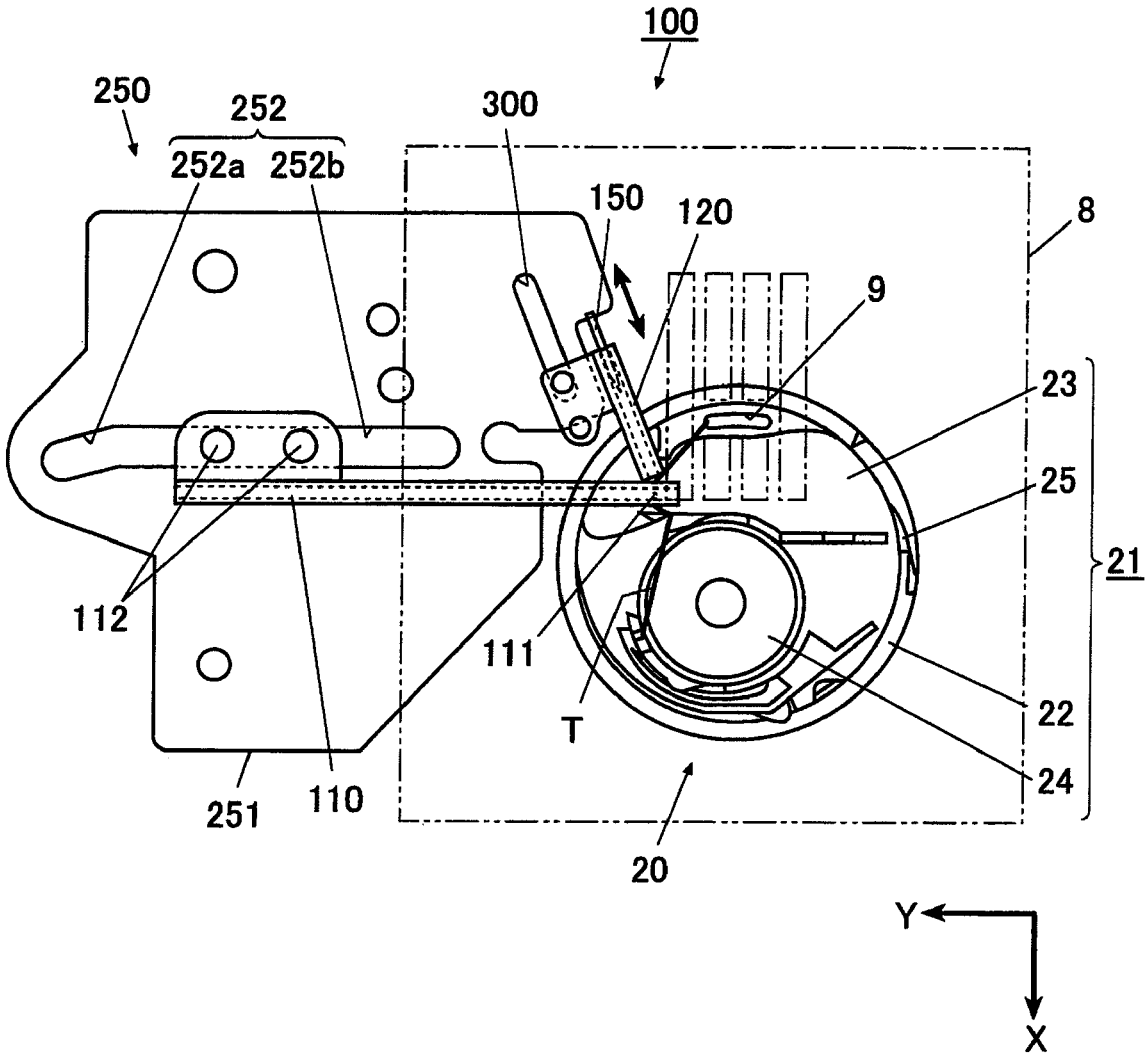
FIG. 9 is a plan view illustrating a configuration of a guide mechanism.
Figure 10:
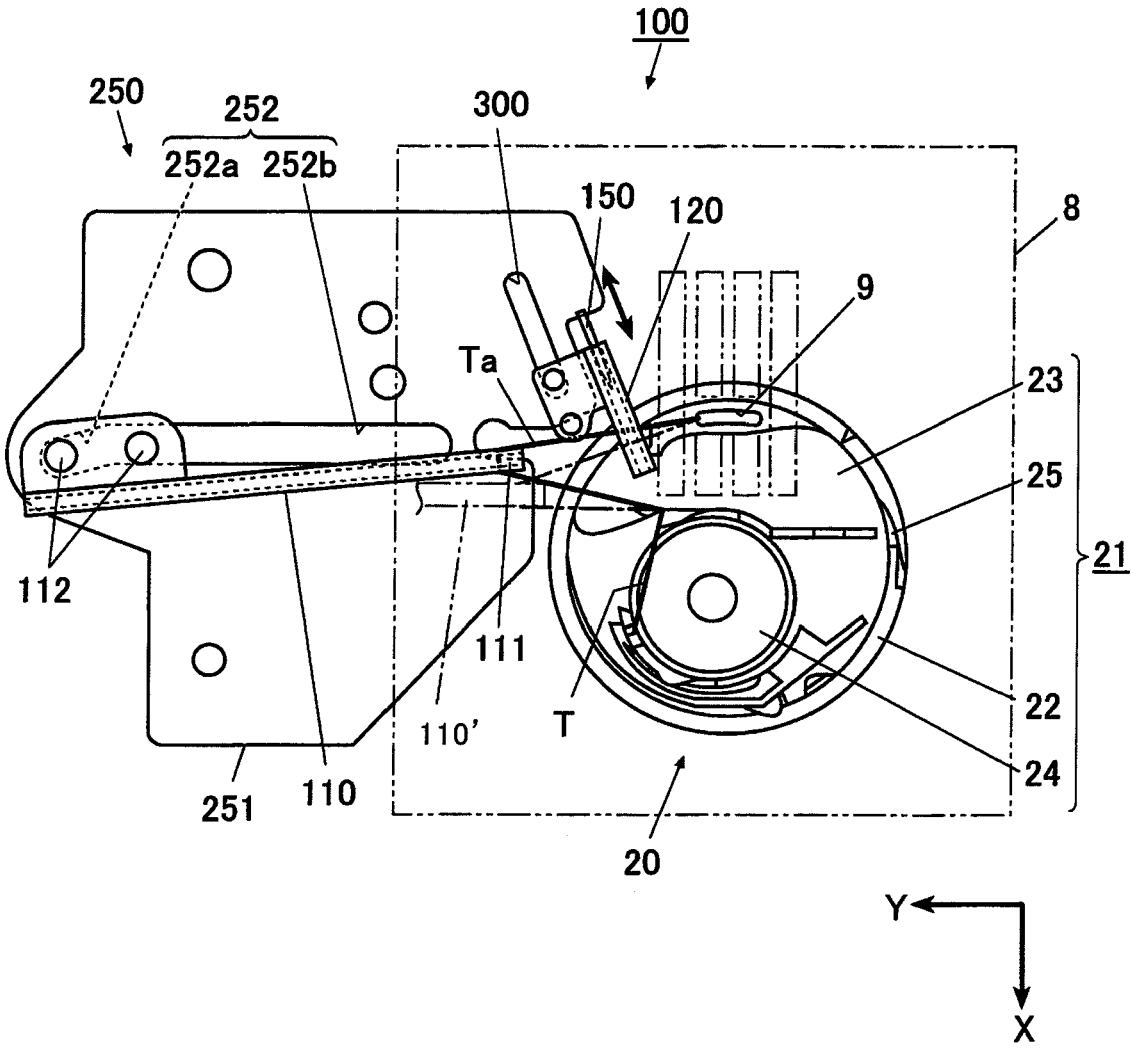
FIG. 10 is another plan view illustrating a configuration of the guide mechanism.

As shown in FIGS. 9 and 10, when the first thread catcher 110 retracts from the region below the throat plate 8 after catching the thread T, the guide mechanism 250 guides the first catching portion 111 of the first thread catcher 110 to become closer to the fixed blade 150 with respect to the moving direction of the second thread catcher 120.

The guide mechanism 250 is disposed between the first thread catcher 110 and the link 133 and includes a base plate 251 (a guide member) which is fixed to the sewing machine frame 10. The base plate is formed with the guide slot 252 which penetrates the base plate 251.

The base plate 251 is disposed between the first thread catcher 110 and the link 133. The two pins 112 extending from the first thread catcher 110 toward the link 133 are slidably inserted in the guide slot 252 from above. Accordingly, the two pins 112 of the first thread catcher 110 which interlocks with the link 133 moves along the guide slot 252 of the base plate 251.

The guide slot 252 extends in the advancing and retracting direction of the first thread catcher 110 (the right-and-left direction in FIG. 9). The guide slot 252 includes a first guide portion 252*b* which guides the first thread catcher 110 from the most advanced position toward the thread catching position at which the first thread catcher 110 catches the thread and a second guide portion 252*a* which is formed continuously from the first guide portion 252*b* to guide the first thread catcher 110 from the thread catching position toward the standby position. The left end of the guide slot 252 is the standby position of the first thread catcher 110, and the right end of the guide slot 252 is the most advanced position of the first thread catcher 110. The thread catching portion is between the standby position and the advanced position, and on the way back from the advanced position to the standby position, the first thread catcher 110 catches the thread at the thread catching position.

The first guide portion 252*b* is parallel to the Y-axis direction, and the right end side thereof guides the first thread catcher 110 to the most advanced position.

As shown in FIG. 3 and FIG. 9, the second guide portion 252*a* is formed so as to incline toward the standby position (i.e., in an obliquely and downwardly left direction in FIG. 9). That is, the second guide portion 252*a* is formed to extend from the first guide portion 252*b* toward a direction away from the second thread catcher 120.

As shown in FIG. 10, when the preceding one of the pins 112 of the first thread catcher 110, i.e. the pin 112 on the left side in FIG. 10, is engaged into the second guide portion 252*a*, the first thread catcher 110 inclines such that the first catching portion 111 on the right side of the first thread catcher 110 having a straight shape moves in the upper direction in FIG. 10, whereby the first catching portion 111 becomes closer to the fixed blade 150 in the moving direction of the second thread catcher 120.

For comparison, a standby position of the first thread catcher 110' used with a guide slot of the related art is shown by a dashed-dotted line in FIG. 10. In comparison with the related art first thread catcher 110', the first thread catcher 110 at the standby position of this embodiment becomes closer to the fixed blade 150.

Accordingly, the thread Ta which is caught by the first thread catcher 110 and extending between the first catching portion 111 of the first thread catcher 110 and the needle hole 9 moves toward the fixed blade 150 and away from the tip end of the second thread catcher 120 (in the upward direction in FIG. 10). Therefore, when the second thread catcher 120 returns to the standby position, the second thread catcher 120 can reliably catch the thread Ta.

Next, a configuration of a control system of the sewing machine 1 will be described in detail with reference to FIG. 11.

Figure 11:
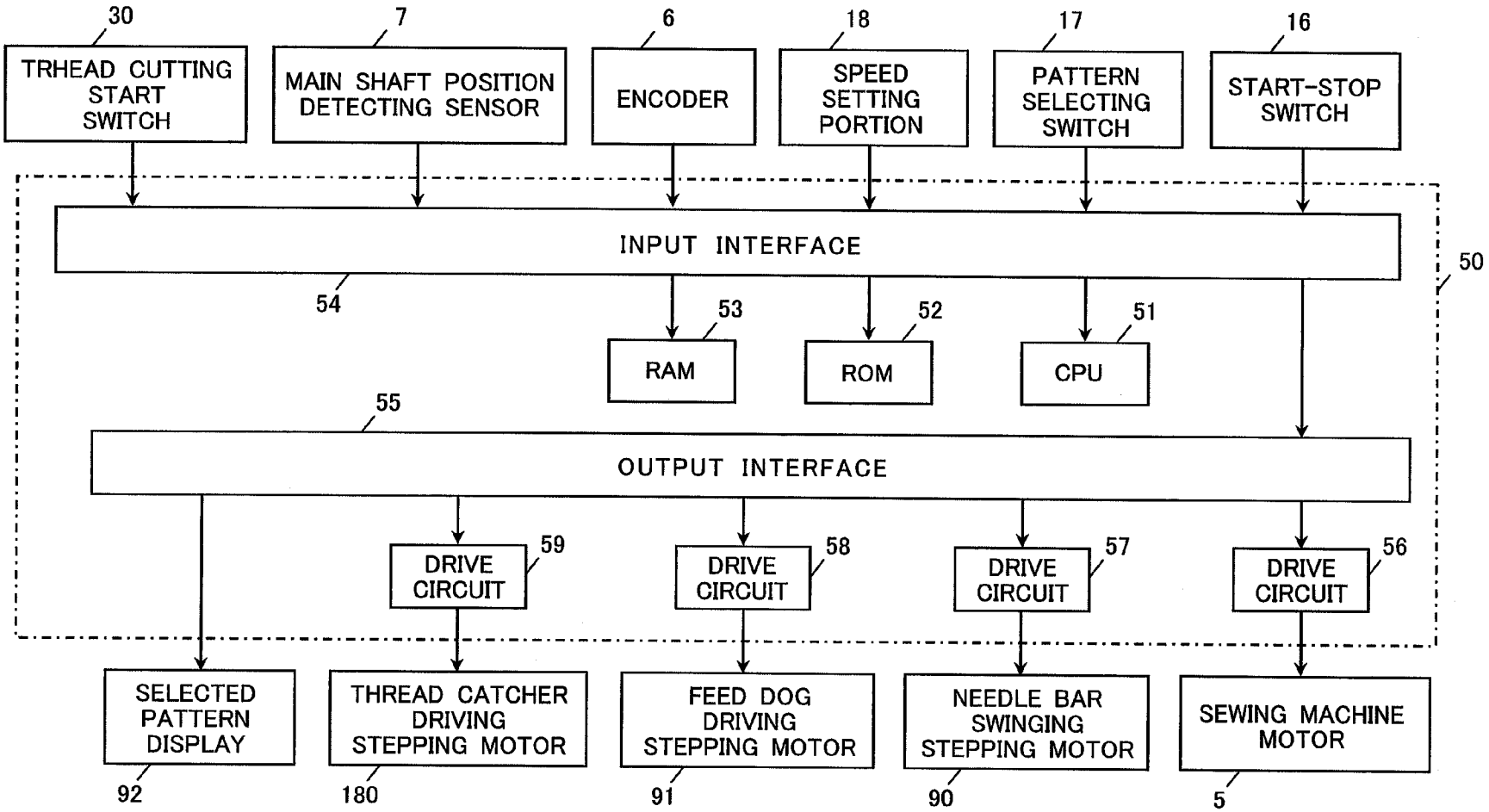
FIG. 11 is a control block diagram of an electric configuration of the sewing machine.
Figure 12:
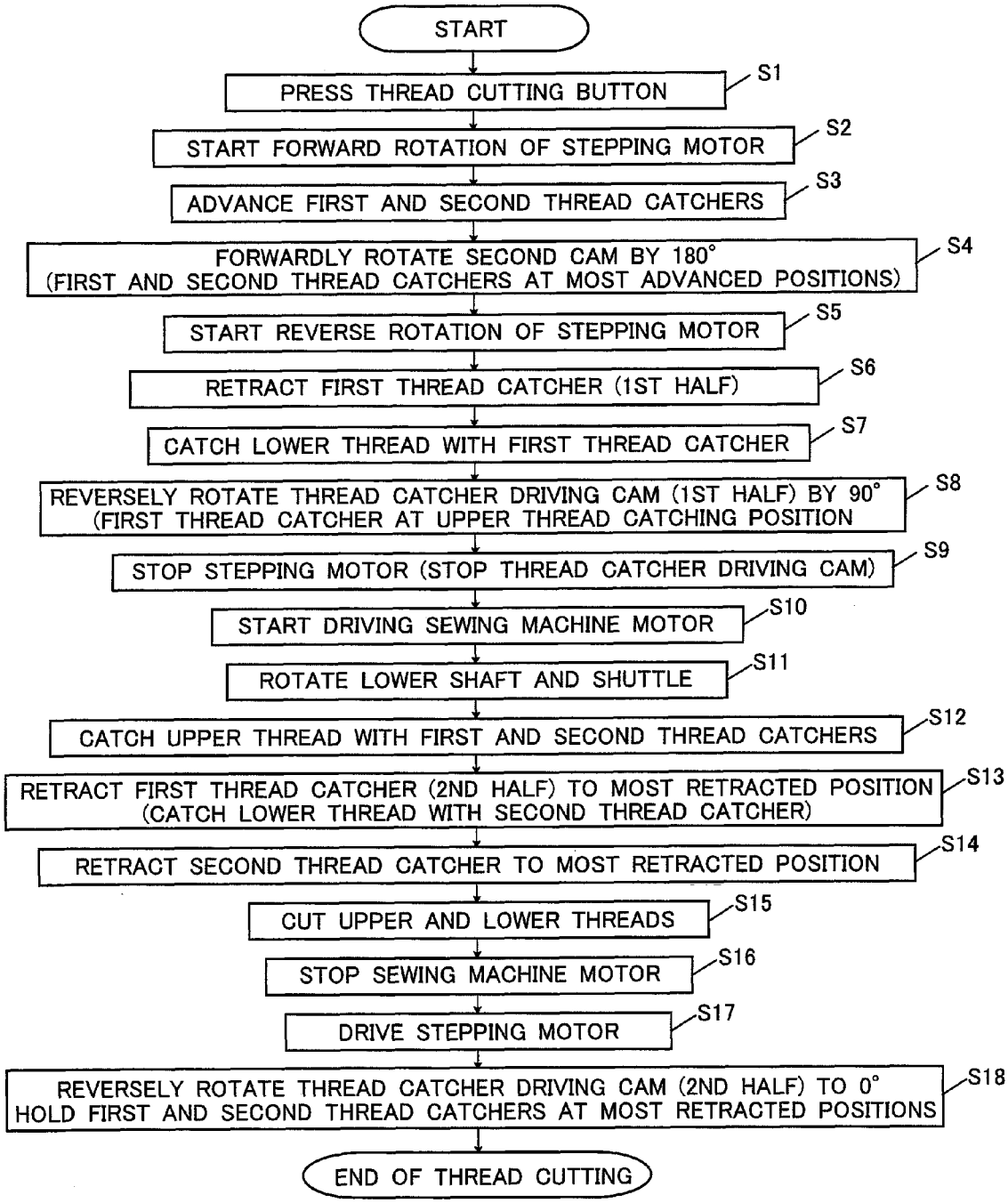
FIG. 12 is a flowchart of operations to be executed by the thread cutting device.

As shown in FIG. 11, the controller 50 includes a ROM 52 in which various programs for performing various controls and processings, sewing data for sewing various patterns and other various setting data are stored, a CPU 51 which executes various programs stored in the ROM 52, a RAM 53 which serves as a work area when executing various programs, an input interface 54 and an output interface 55 coupled to the CPU 51, the ROM 52, and the RAM 53 via buses, a switching drive circuit 56 which performs driving by supplying power to the sewing machine motor 5, a drive circuit 57 which performs driving by supplying power to the needle bar swinging stepping motor 90, a drive circuit 58 which performs driving by supplying power to the feed dog driving stepping motor 91, and a drive circuit 59 which performs driving by supplying power to the thread catcher driving stepping motor 180.

The input interface 54 transmits input signals from the start-stop switch 16, the pattern selecting switch 17, the speed setting portion 18, the encoder 6, and the main shaft position detecting sensor 7 to the CPU 51, and the output interface 55 controls the drive circuits 56, 57, 58, 59 and the selected pattern display 92 according to commands from the CPU 51.

The encoder 6 includes a disk and an optical sensor attached to a rotation shaft of the sewing machine motor 5. The disk has slits opened at regular intervals along the circumference, and the optical sensor includes a light source and a light receiving device which are arranged across the disk. When the upper shaft rotates by 360 degrees, a pulse signal is generated from the light receiving device according to repetition of transmission and blocking of light from the light source. The encoder 6 is designed such that the optical sensor generates, for example, 180 pulses per a 360-degree rotation of the upper shaft. The pulse signal output from the encoder 6 is input into a pulse counter of the input interface 54.

In the controller 50, in response to input signals from the start-stop switch 16, the pattern selecting switch 17, the speed setting portion 18, the encoder 6, and the main shaft position detecting sensor 7, the CPU 51 performs arithmetic processing by using the RAM 53 as a work area based on various control programs stored in the ROM 52, and executes sewing control by driving various actuators of the sewing machine motor 5, the needle bar swinging stepping motor 91, and the feed dog driving stepping motor 91, etc., by outputting output signals corresponding to the arithmetic processing results to the actuators.

Further, the controller 50 of this embodiment functions as cutting control means for cutting the thread T by moving the second thread catcher 120 by driving the sewing machine motor 5 after catching the thread T by moving the first thread catcher 110 by driving the stepping motor 180. In detail, when pressing on the thread cutting switch 30 is detected, in the controller 50, the CPU 51 reads a detection signal of the main shaft position detecting sensor 18, and when the lower shaft 2 is positioned at a certain rotational angle (e.g., an angle at which the needle bar is stopped at the lower position), by forwardly driving the stepping motor 180, moves the first thread catcher 110 and the second thread catcher 120 from the most retracted positions to the most advanced positions. Thereafter, the stepping motor 180 is driven in the reverse direction to move the first thread catcher 110 to the thread catching position, which is on the way of its retracting movement, while maintaining the second thread catcher 120 at the most advanced position. This control is performed by driving the stepping motor 180 so as to rotate the second cam 170 by a predetermined amount around the axis according to the cam shapes (see FIG. 7) of the circumferential cam portion 174 and the end cam portion 175 formed at predetermined phases in the circumferential direction of the second cam 170.

After executing the above-described control, by stopping the stepping motor 180 and driving the sewing machine motor 5, the controller 50 moves the first thread catcher 110, which has caught the thread T, back to the most retracted position while maintaining the second thread catcher 120 at the most advanced position, and then moves the second thread catcher 120 to the most retracted position.

Next, based on the flowchart of FIG. 12 and FIG. 13A to FIG. 20, operations of the sewing machine 1 having the configuration above described will be described.

Figure 13A:
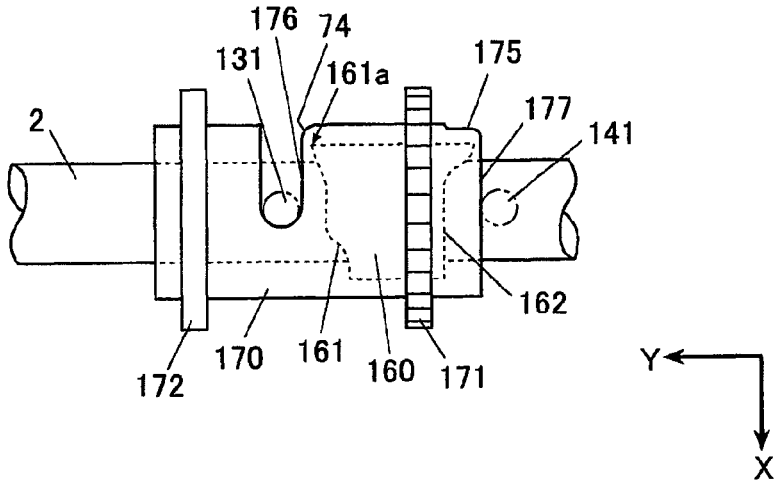
FIG. 13A to FIG. 20 are explanatory views illustrating the respective operations of the thread cutting device.
Figure 13B:
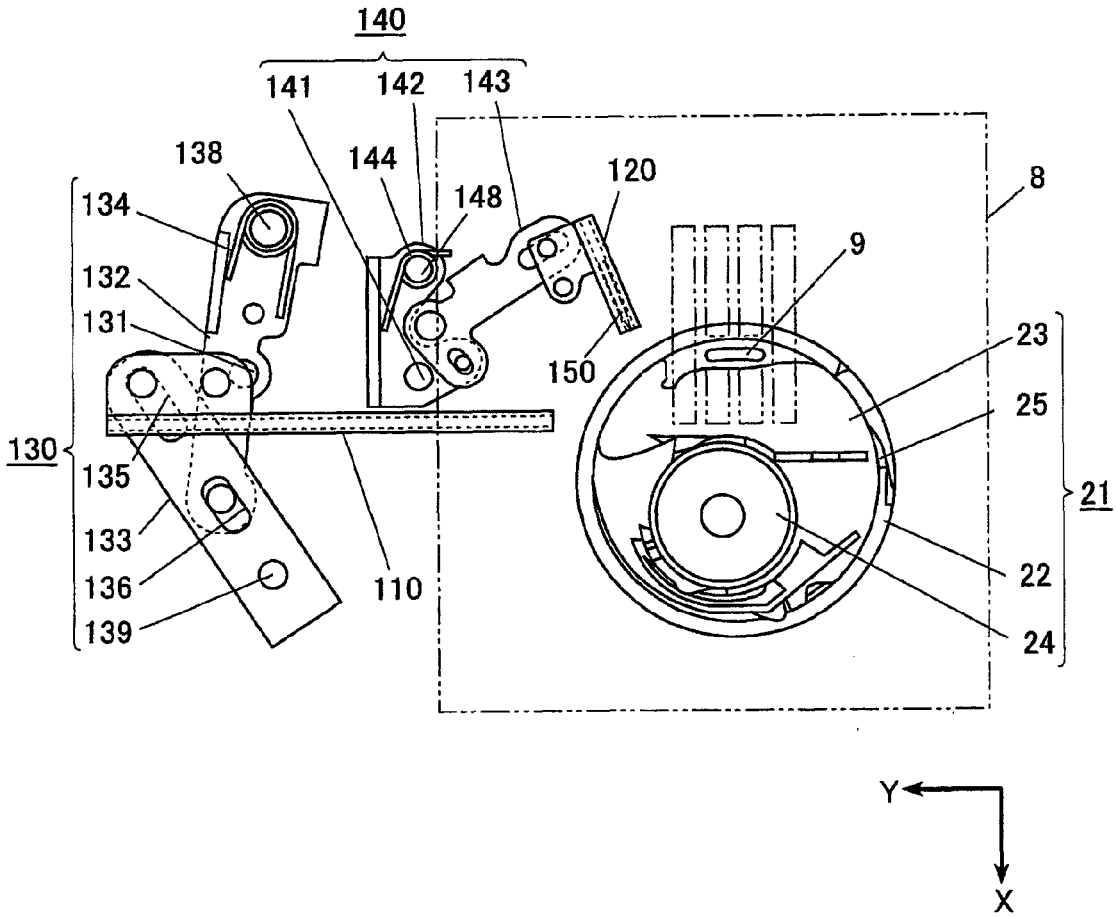

As shown in FIG. 13A, during the stitching operation, the first cam follower 131 of the first link mechanism 130 is arranged at the standby portion 176 of the circumferential cam portion 174 of the second cam 170, and the second cam follower 141 of the second link mechanism 140 is held in a state where it is arranged at the standby portion 177 of the end cam portion 175 of the second cam 170. Therefore, the lower shaft 2 and the first cam 160 are freely rotatable without interference between the cam followers 131, 141 and the first cam 160. As shown in FIG. 13B, the first thread catcher 110 and the second thread catcher 120 stand by at the most retracted positions, i.e., at the standby positions.

Figure 14A:
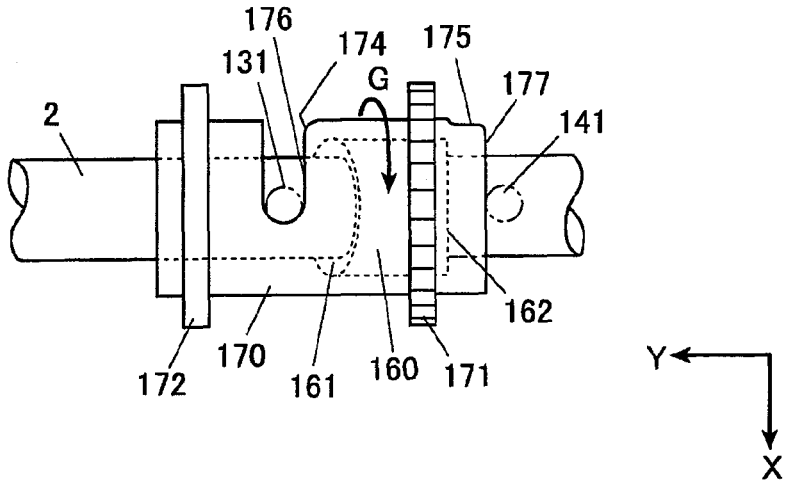
Figure 14B:
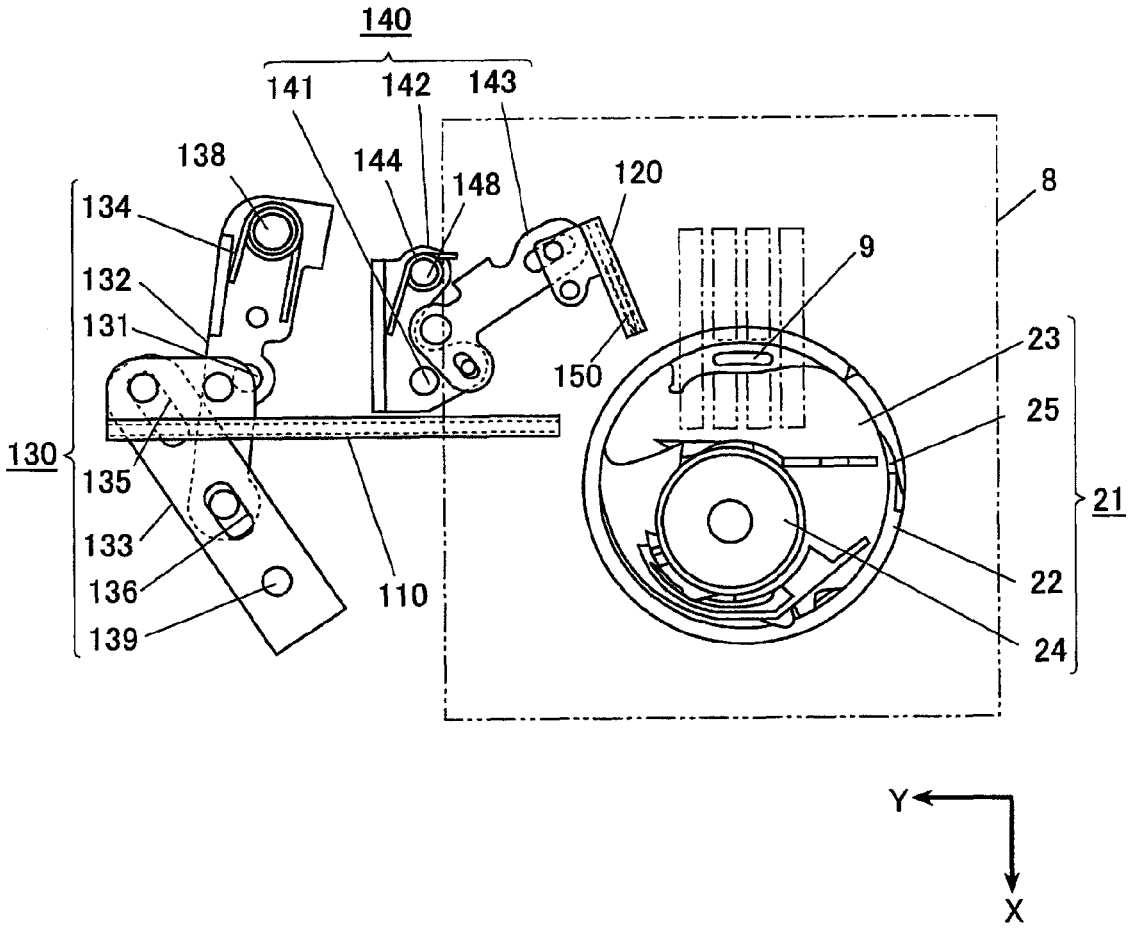

When the stitching operation is finished, the sewing machine motor 5 stops, and the upper shaft and the lower shaft 2 stop in a state where the needle 3 is stopped at the lower position. At this time, as shown in FIG. 14A, the tip end 161*a* of the end cam portion 161 of the first cam 160 is arranged at the opposite side of the first cam follower 131 with respect the axis line of the lower shaft 2, that is, arranged at the lower side and the first cam 160 is stopped. Accordingly, when the second cam 170 is driven, spaces for allowing the cam followers 131, 141 to move so as to move the first thread catcher 110 and the second thread catcher 120 to the most advanced positions are provided. As shown in FIG. 14B, at this time, the first thread catcher 110 and the second thread catcher 120 stand by in a state where they are still arranged at the standby positions.

Next, when the thread cutting button 30 is pressed and a thread cutting operation start signal is detected (Step S1), the CPU 51 drives and forwardly rotates the stepping motor 180 via the drive circuit 59 (Step S2) to rotate the second cam 170 in the circumferential direction G. Then, the first cam follower 131 in contact with the circumferential cam portion 174 due to the biasing force of the spring 134, is moved rightward in FIGS. 14A and 14B along the circumferential cam portion 174, and the link 132 turns around the pivot 138 in the direction A to forwardly move the first thread catcher 110. Accordingly, the first thread catcher 110 is moved in the advancing direction C1 (Step S3). According to the rotation of the second cam 170, the second cam follower 141 in contact with the end cam portion 175 due to the biasing force of the spring 144 is moved leftward in FIGS. 14A and 14B along the end cam portion 175. Accordingly, the link 142 is turned around the pivot 148 in the direction B1, and the second thread catcher 120 moves in the advancing direction C1 (Step S3).

Figure 15A:
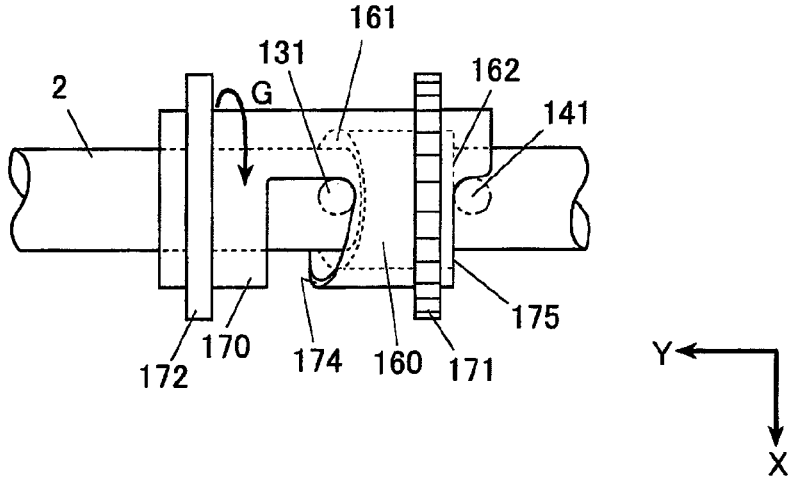
Figure 15B:
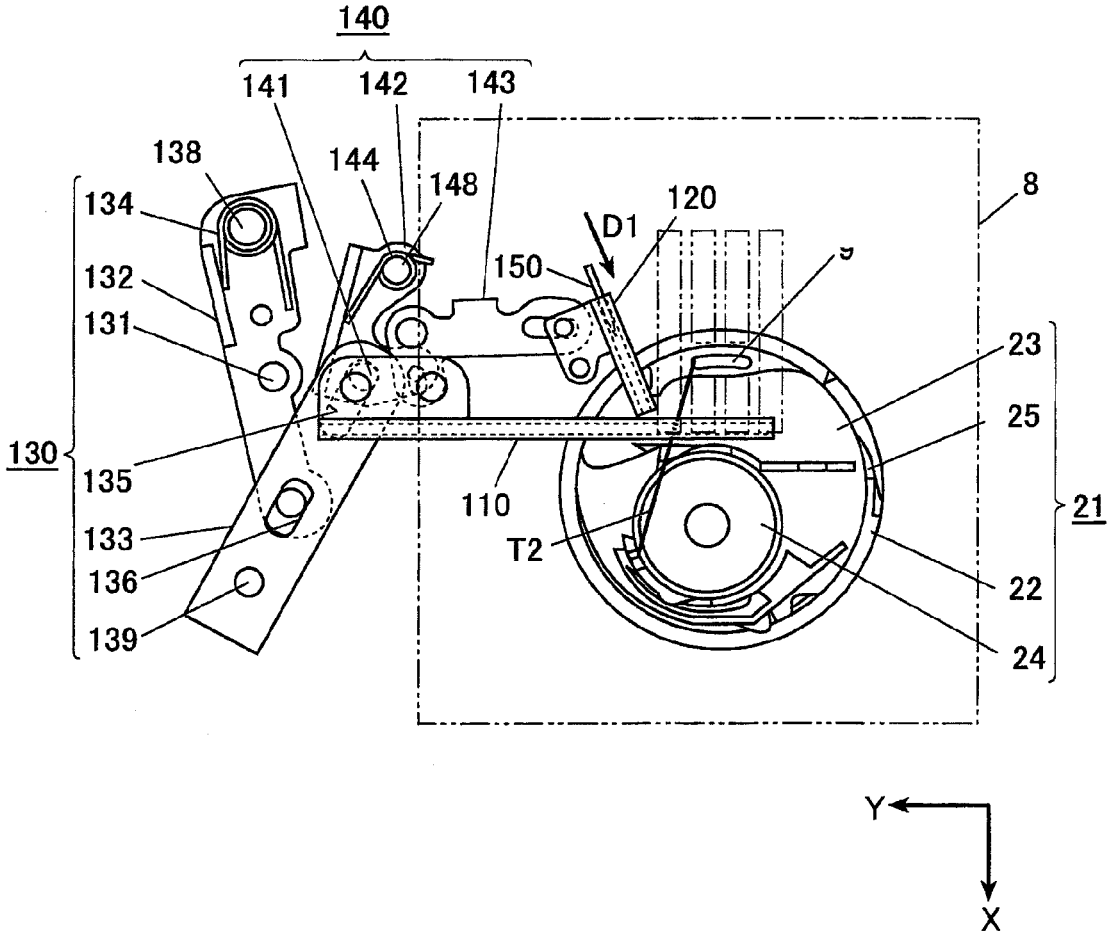

As shown in FIG. 15A, when the stepping motor 180 is driven until the second cam 170 is rotated by 180 degrees in the direction G from its initial position (Step S4), as shown in FIG. 15B, the first thread catcher 110 is moved to the most advanced position so that the first catching portion 111 passes through the path of the lower thread T2 extending between the bobbin 24 and the needle hole 9 below the throat plate 8. Further, in accordance with the rotation of the second cam 170, the second thread catcher 120 is moved to the most advanced position near the stitching point at which the second catching portion 121 becomes close to the first thread catcher 110 above the horizontal shuttle 21 (see FIG. 15B).

Figure 16A:
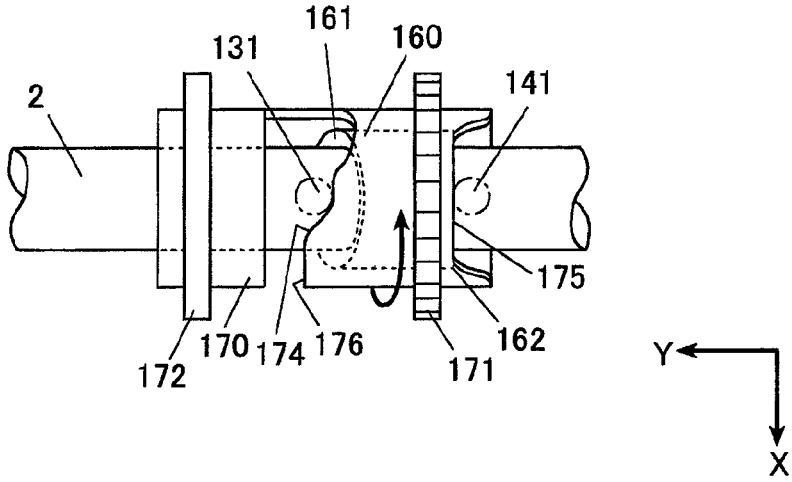
Figure 16B:
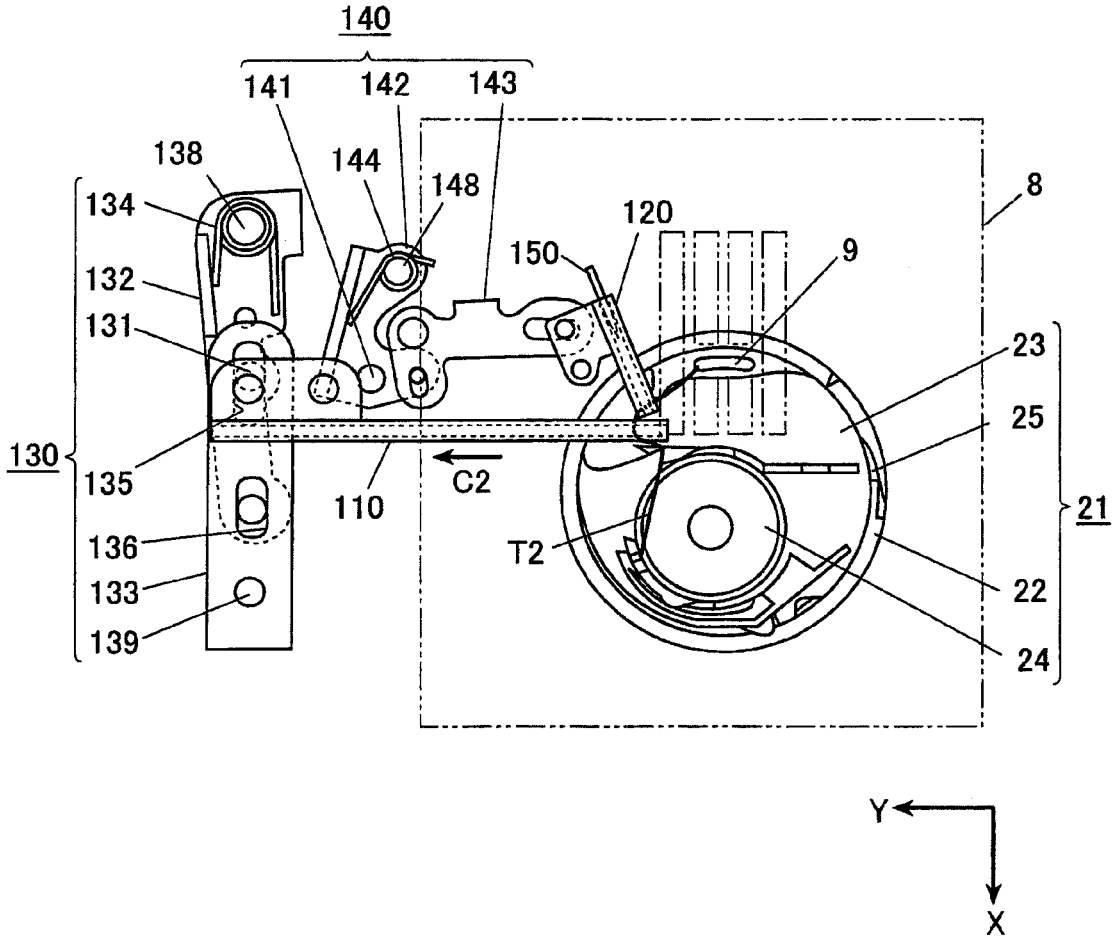

When the first thread catcher 110 is moved to the most advanced position, the CPU 51 rotates the second cam 170 in the reverse direction by reversely rotating the stepping motor 180 at a low speed via the drive circuit 59 (Step S5), and retracts the first thread catcher 110 at a low speed via the first link mechanism 130 (Step S6). Accordingly, the first thread catcher 110 is retracted, and the lower thread T2 is caught by the first catching portion 111 (step S7), and the lower thread T2 is slowly drawn out of the bobbin 24. As shown in FIG. 16A, when the second cam 170 is reversely rotated to a position of 90 degrees from its initial position (Step S8), and as shown in FIG. 16B, the first thread catcher 110 moves to an upper thread catching position which is on the way of its retracting movement (first half), the CPU 51 stops the stepping motor 180 via the drive circuit 59 (Step S9), and drives the sewing machine motor 5 via the drive circuit 56 (Step S10). As shown in FIG. 16B, in the state where the stepping motor 180 is stopped in Step S9, the first thread catcher 110 at the upper thread catching position and the second thread catcher 120 at the most advanced position are arranged such that their tip ends point against each other, and the first catching portion 111 and the second catching portion 121 becomes close to each other. In this state, only the lower thread T2 is caught by the first catching portion 111, and none of the threads T (T1, T2) are caught by the second catching portion 121.

Figure 17A:
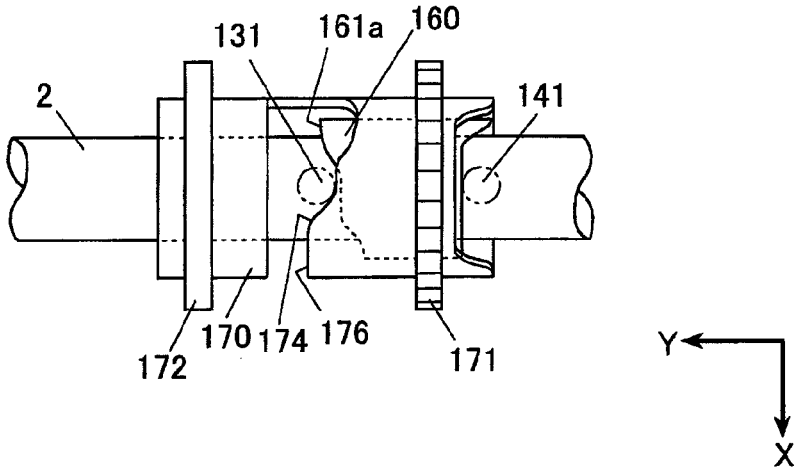
Figure 17B:
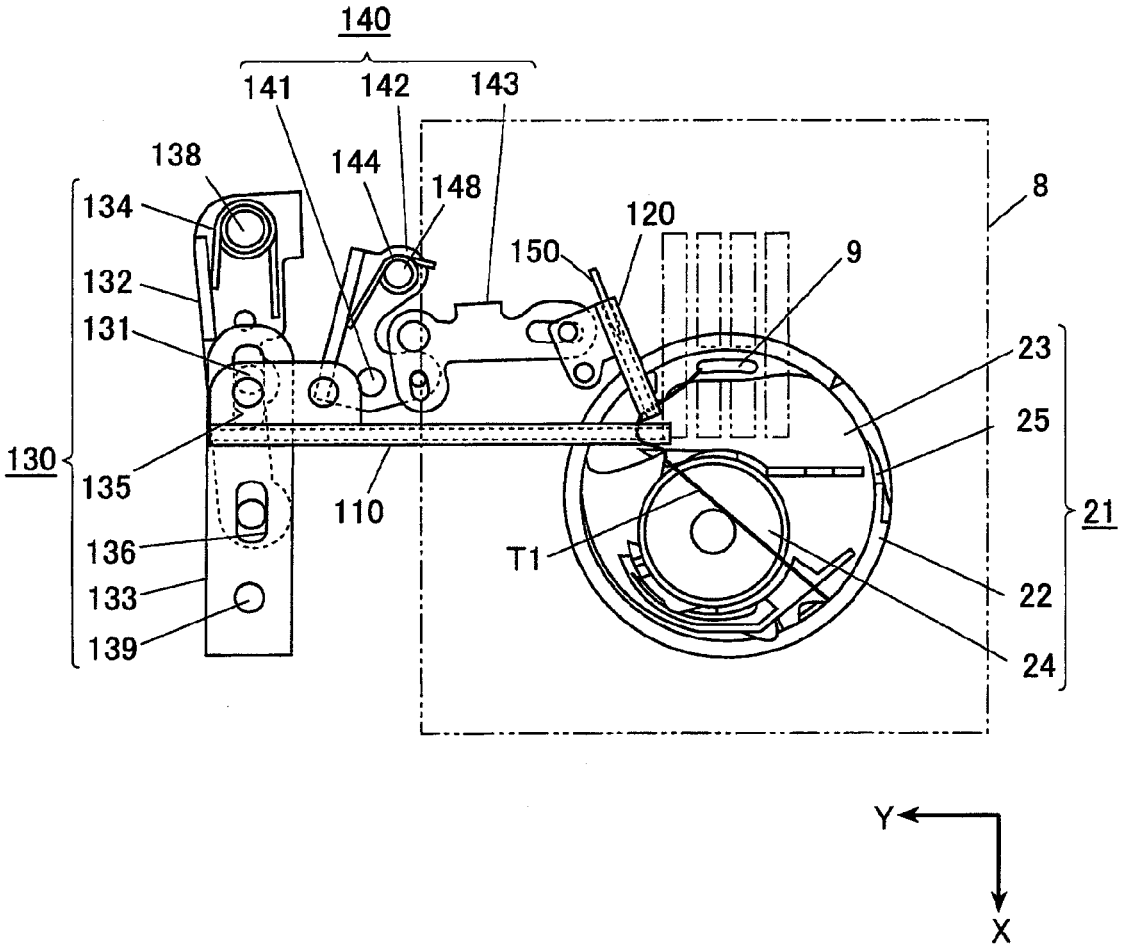
Figure 18A:
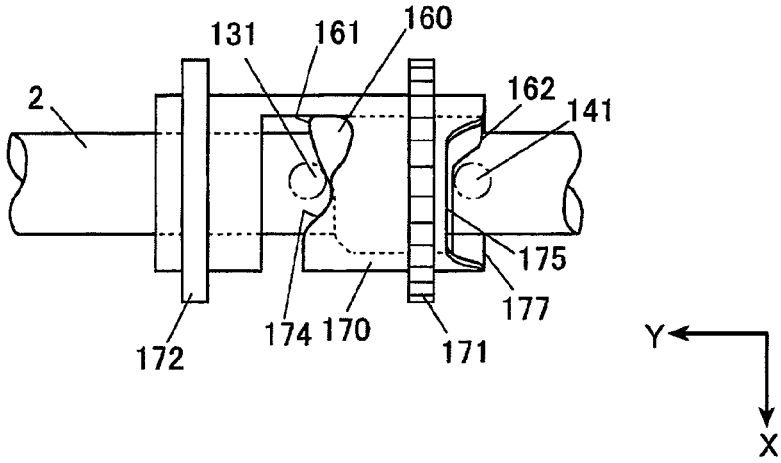
Figure 18B:
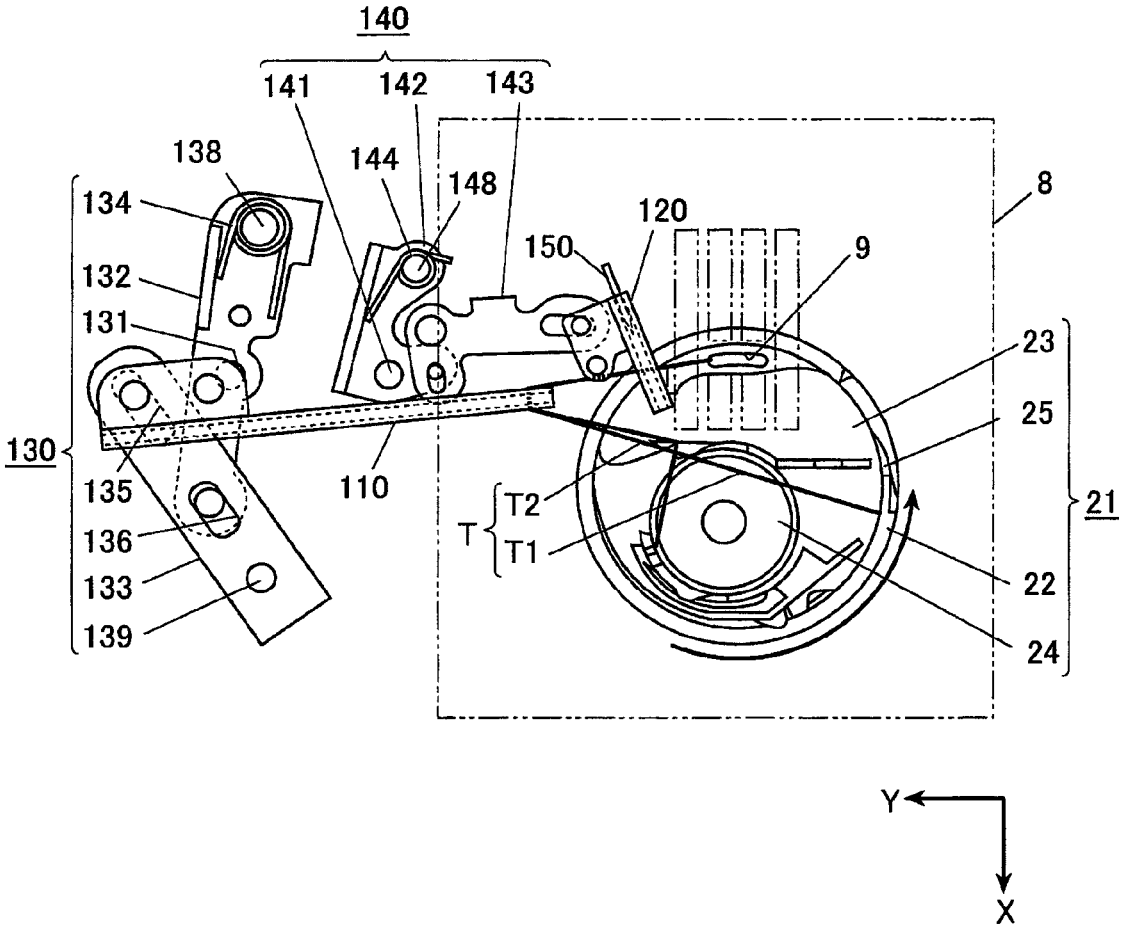

As shown in FIGS. 17A and 18A, when the sewing machine motor 5 is driven, the lower shaft 2 and the first cam 160 rotate, and the horizontal shuttle 21 (the outer shuttle 22) coupled to the lower shaft 2 rotates (Step S11). The horizontal shuttle 21 (the outer shuttle 22) is rotated at the rotation speed that is twice as high as the rotation speed of the lower shaft 2, and therefore, when the lower shaft 2 rotates by half, that is, by about 180 degrees, the horizontal shuttle 21 (the outer shuttle 22) rotates by about 360 degrees, that is, makes a 360-degree rotation. As shown in FIG. 17B, during the half rotation of the lower shaft 2 and the first cam 160, the upper thread T1 which passed through the outer shuttle 22 is caught concurrently by the catching portions 111 and 121 of the thread catchers 110 and 120 (Step S12). In other words, at this time, the upper thread T1 and the lower thread T2 are caught by the first catching portion 111, and the upper thread T1 is caught by the second catching portion 121. As shown in FIG. 18A, when the end cam portion 161 of the first cam 160 rotates to a position at which it comes into contact with the first cam follower 131, the first cam follower 131 is moved leftward along the end cam portion 161. Along with this, the first thread catcher 110 is further retracted (second half).

Figure 20:
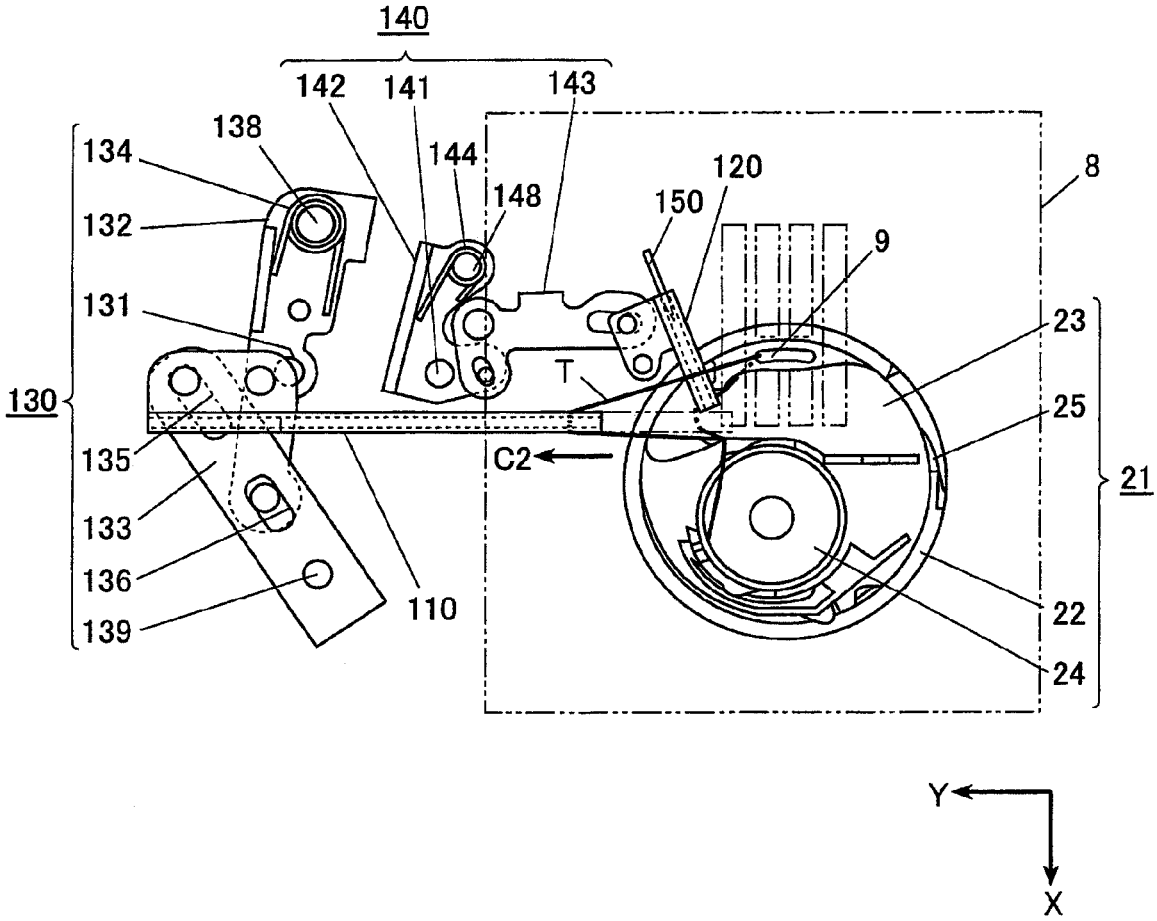

As shown in FIG. 20, by retracting the first thread catcher 110 from the upper thread catching position to the most retracted position, among the upper thread T1 and the lower thread T2 caught by the first catching portion 111, an angle of the lower thread T2 extending between the second catching portion 111 and the needle hole 9 changes. In other words, in accordance with the retracting movement of the first thread catcher 110 (second half), the lower thread T2 extending between the first catching portion 111 and the needle hole 9 becomes close to the direction parallel to the Y-axis direction in the plan view.

Further, by the retracting movement of the first thread catcher 110, one of (may be both) the pins 112 provided on one end of the first thread catcher 110 is eventually guided to the second guide portion 252*a* of the guide slot 252 of the base plate 251. Because the second guide portion 252*a* formed such that the guide slot 252 is bent in a direction away from the second thread catcher 120, the end portion of the first thread catcher 110 where the pins 112 are provided moves away from the second thread catcher 120 along the second guide portion 252*a*.

On the other hand, the other end portion of the first thread catcher 110 where the pins 112 are not provided, that is, the first catching portion 111 catching the thread, moves so as to turn toward the fixed blade 150 in accordance with the movement of the pins 112 along the bent portion 252*a*.

Accordingly, as the lower thread T2 is pulled by the retracting movement of the first thread catcher 110, the direction in which the lower thread T2 extends between the first catching portion 111 and the needle hole 9 becomes close to a direction parallel to the Y-axis direction when seen in the plan view. Further, by the turning movement of the first catching portion 111 toward the fixed blade 150, the thread T2 further enters inside the moving range of the second thread catcher 120.

According to the angle change of the lower thread T2, the lower thread T2 is guided downward along the curved surface on the tip end of the second thread catcher 120 and caught by the second catching portion 121. Therefore, in the state where the first thread catcher 110 is arranged at the most retracted position shown in FIG. 18B, the upper thread T1 and the lower thread T2 are caught by both of the first and second catching portions 111,121 (Step S13).

Figure 19A:
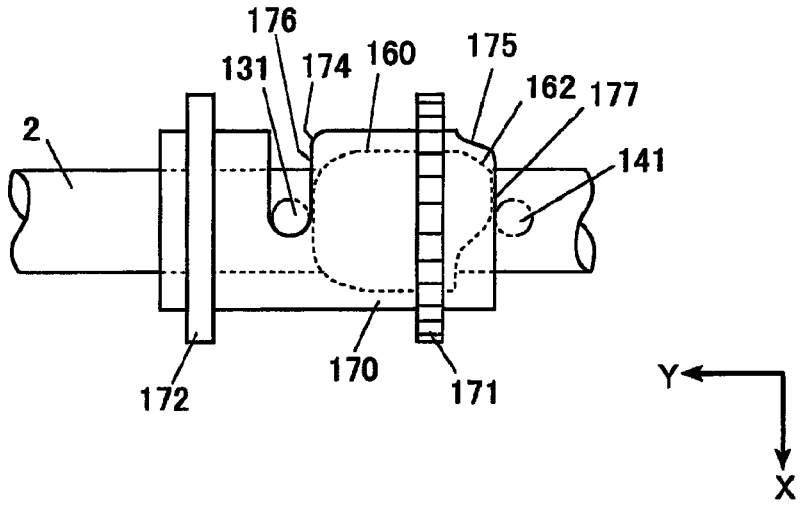
Figure 19B:
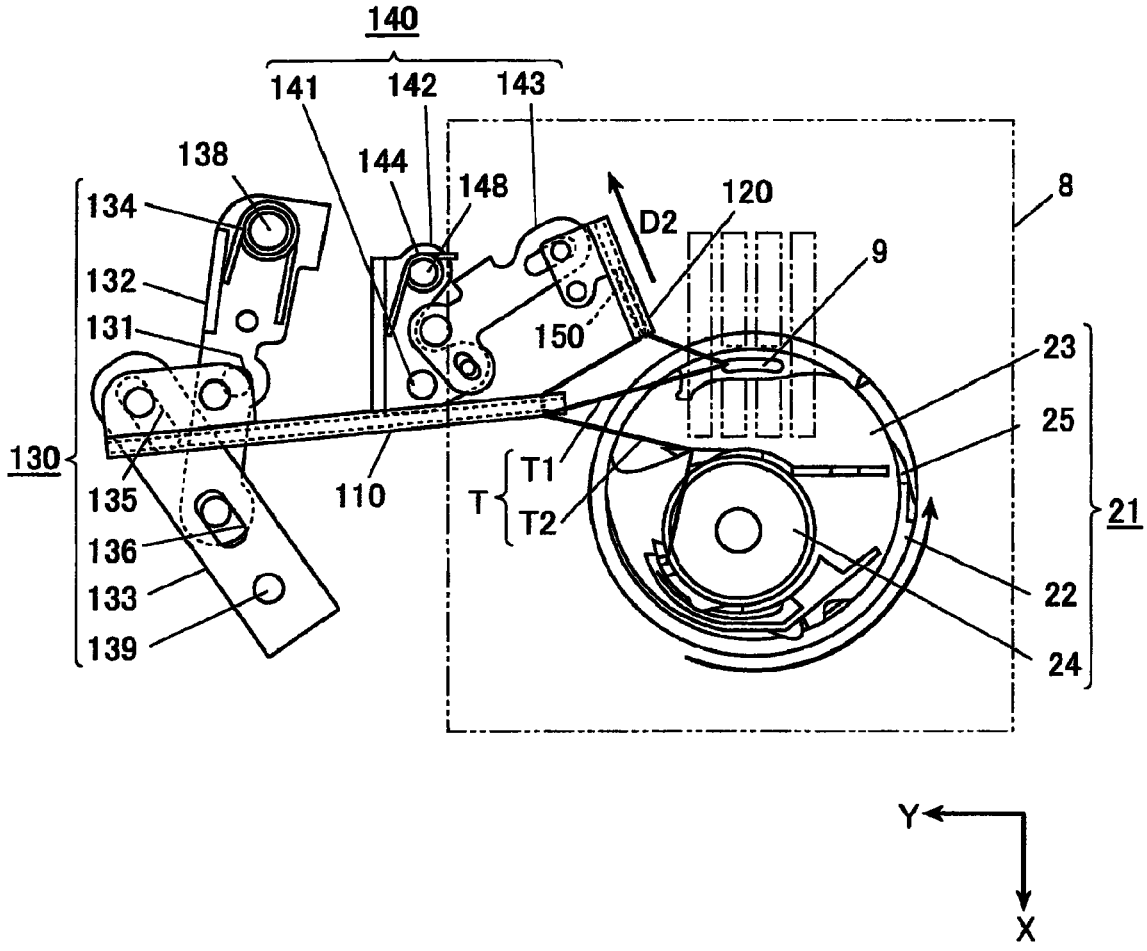

As shown in FIG. 19B, the second catching portion 121 of the second thread catcher 120 passes through the thread cutting position and further retracts to the most retracted position (Step S14), whereby the upper thread T1 and the lower thread T2 are guided to the fixed blade 150 by the second catching portion 121 and are cut (Step S15).

Thereafter, as shown in FIG. 19A, when the lower shaft 2 and the first cam 160 rotate by 180 degrees, the first cam follower 131 is guided to the tip end 161*a* of the end cam portion 161 of the first cam 160, and the first thread catcher 110 is retracted to the vicinity of the standby position which is the initial position. Further, the second cam follower 141 is guided to the tip end of the end cam portion 162 of the first cam 160, and the second thread catcher 120 is retracted to the vicinity of the standby position which is the initial position.

Further, the CPU 51 stops the sewing machine motor 5 via the drive circuit 56 (Step S16), and then restarts the reverse rotation driving of the stepping motor 180 (second half) via the drive circuit 59 to execute processing for driving the second cam 170 in reverse direction to the origin position (Step S17). Accordingly, the second cam 170 rotates in reverse to the initial position (0 degrees), the first cam follower 131 is guided into the standby portion 176 of the circumferential cam portion 174, and the second cam follower 141 is guided to the standby portion 177 of the end cam portion 175. Therefore, both the first thread catcher 110 and the second thread catcher 120 are held at the most retracted positions (Step S18), whereby the thread cutting processing is ended and the sewing machine becomes ready for the subsequent stitching operation.

As described above, the thread cutting device 100 is configured such that, after catching the thread T with the first thread catcher 110, the thread T extending between the first catching portion 111 of the first thread catcher 110 and the needle hole 9 is further caught by the second thread catcher 120 and is guided to the fixed blade 150, whereby the thread T is cut. Therefore, the thread T can be cut at a portion closer to the needle hole 9. That is, in comparison with the thread cutting device of the related art in which the thread T is cut by catching the thread T and guiding the thread T toward the fixed blade with the single thread catcher 610, the residual length of the thread T remaining on the side of the cloth after being cut can be shortened, and the residual length of the thread T remaining on the side of the sewing machine 1 can be made longer. Accordingly, the labor and time necessary for cutting the residual thread T on the side of the cloth in an appropriate length can be reduced, and in the subsequent sewing operation, the threads can be efficiently locked together, whereby the entire operational efficiency can be improved.

Further, the first guide portion 252*b* of the guide slot 252 guides the first catching portion 111 of the first thread catcher 110 from the most advanced position toward the thread catching position to retract the first thread catcher 110 from the region below the throat plate 8 and to catch the thread. Therefore, as shown in FIG. 21B, the angle θ between the straight line connecting the needle hole 9 and the first catching portion 111 of the first thread catcher 110 and the straight line along the advancing and retracting direction of the first thread catcher 110 is reduced, so that the thread extending between the first catching portion 111 of the first thread catcher 110 and the needle hole 9 of the throat plate 8 is easily caught by the second thread catcher 120.

Figure 21A:
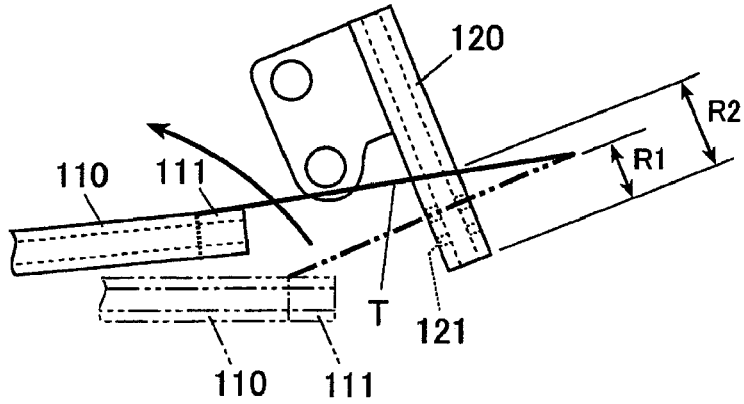
FIG. 21A is an explanatory view illustrating a location of a thread that is caught by the second thread catcher.
Figure 21B:
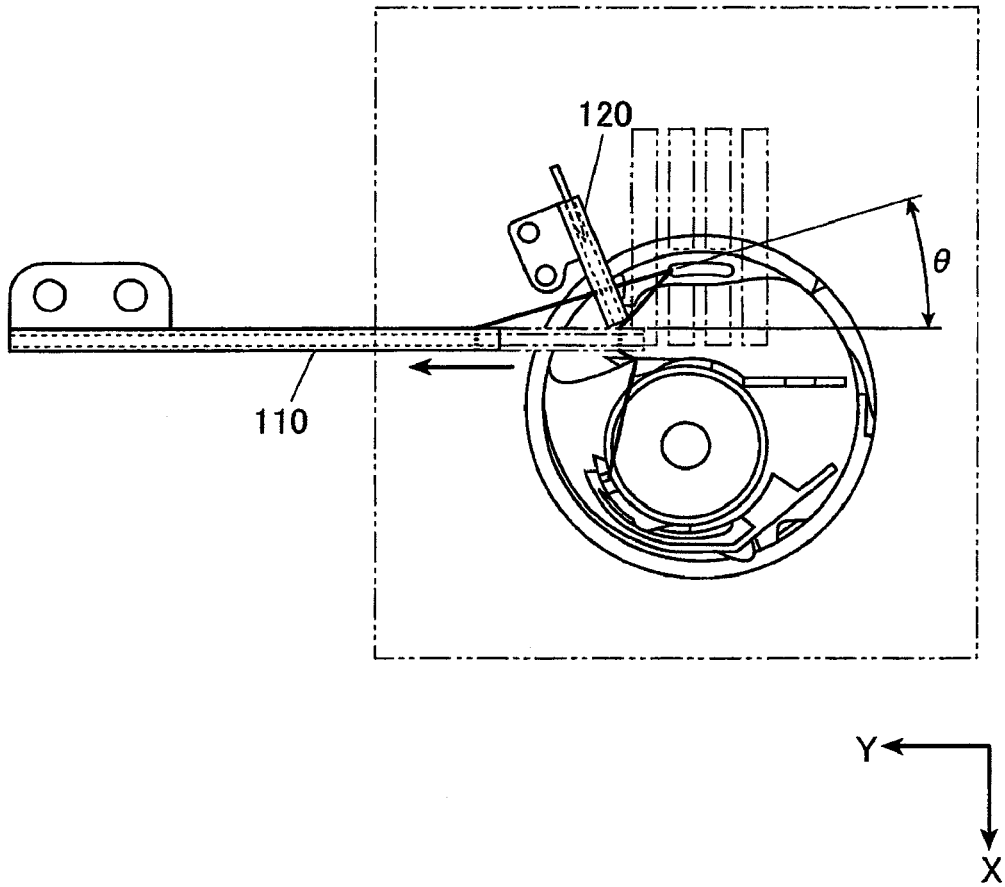
FIG. 21B is an explanatory view illustrating a relationship between the thread and the second thread catcher.
Figure 22A:
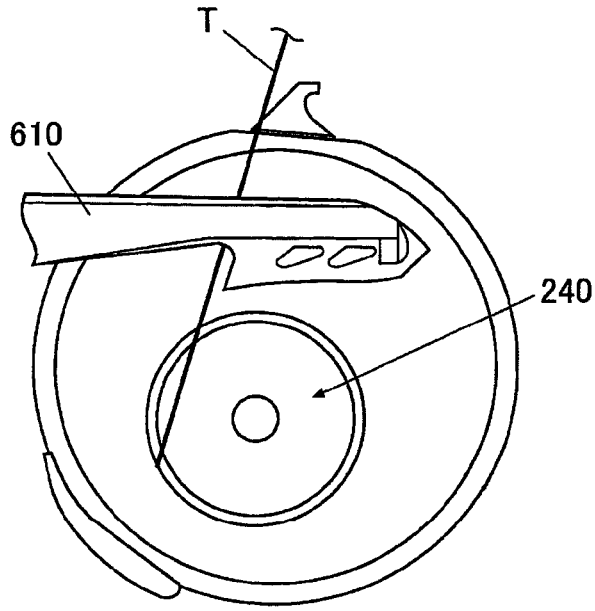
FIG. 22A and FIG. 22B are schematic views illustrating a thread catching operation of the related art thread cutting device.
Figure 22B:
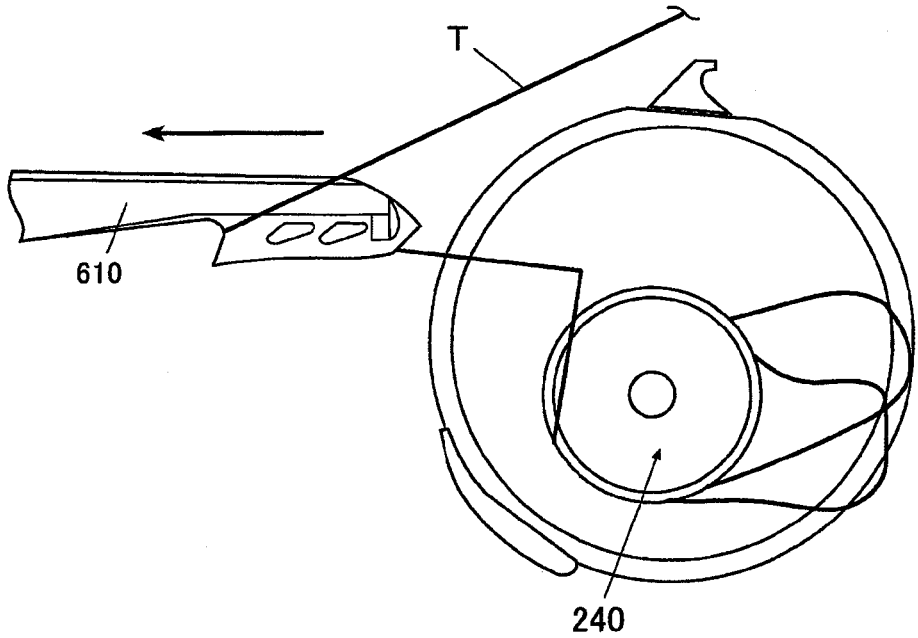
Figure 23:
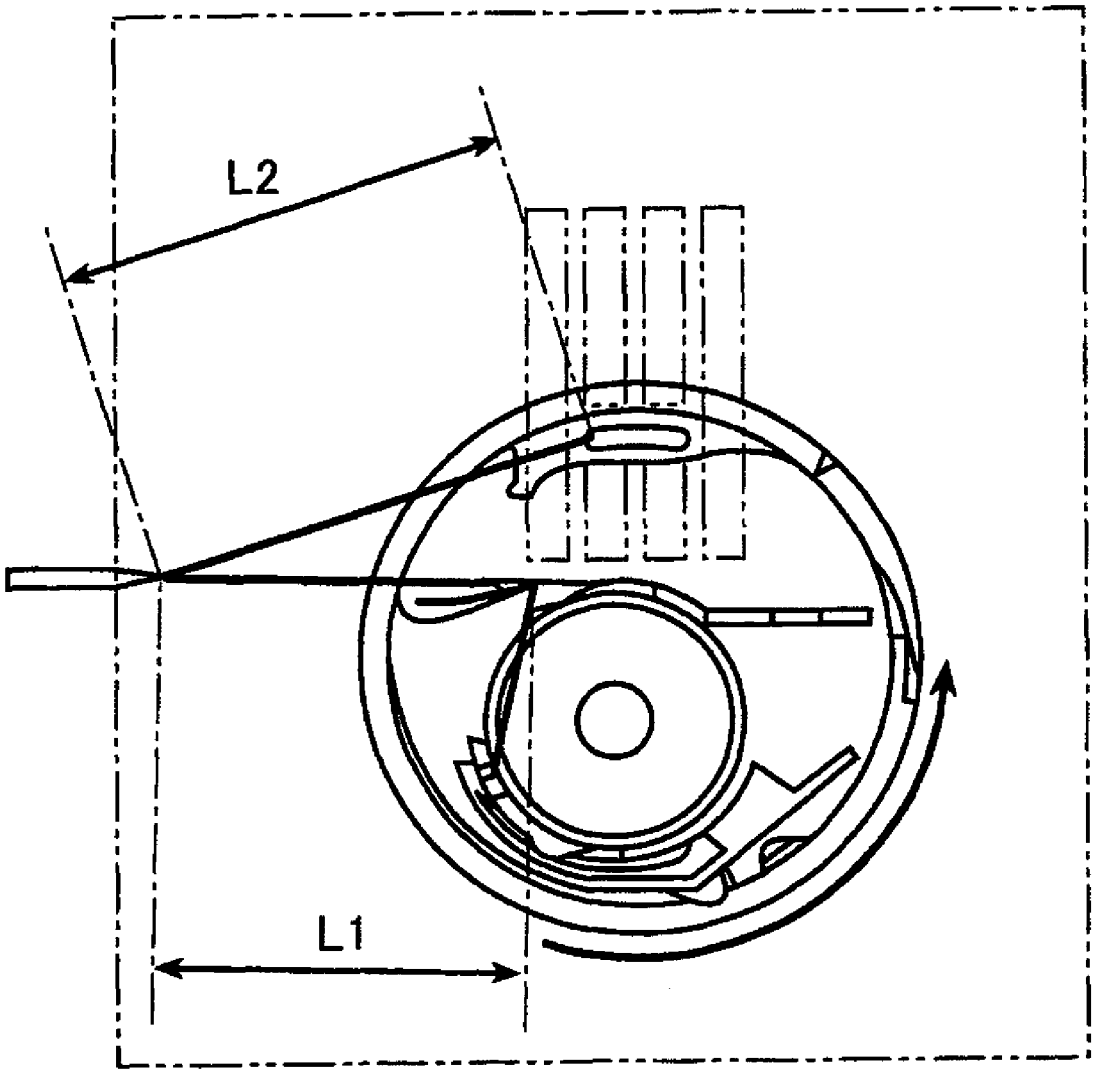
FIG. 23 is an explanatory view illustrating the residual lengths of the thread in the related art thread cutting device.

Furthermore, as shown in FIG. 21A, the thread comes closer to the fixed blade 150 due to the second guide portion 252*a* of the guide slot 252, so that the moving distance of the second thread catcher 120 for catching the thread can be shortened. Even if the movement stroke of the second thread catcher 120 is not changed, as shown in FIG. 21A, the distance from the tip end of the second thread catcher 120 to the position of the thread becomes longer (the distance changes from R1 to R2 in FIG. 21A), so that the thread can be more reliably caught by the second catching portion 121 of the second thread catcher 120.

While the stepping motor 180 is driven in response to an input of a thread cutting signal by pressing of the thread cutting button 30 in the embodiment described above, the controller 50 may automatically drive the stepping motor 180 in response to a detection signal from detecting means (may be, for example, the main shaft position detection sensor 7) for detecting that the lower shaft 2 is positioned at a certain rotation angle.

What is claimed is:

1. A thread cutting device of a sewing machine, the sewing machine comprising a needle which moves up and down, a throat plate formed with a needle hole through which the needle passes, and a horizontal shuttle which rotates below the throat plate to form a stitch in cooperation with the needle, wherein the thread cutting device is configured to cut a thread extending between the horizontal shuttle and the needle hole, the thread cutting device comprising:

a fixed blade;

a first thread catcher configured to catch the thread;

a second thread catcher configured to catch the thread and to pull the thread toward the fixed blade to cut the thread;

a driving assembly configured to move the first thread catcher and the second thread catcher such that the first thread catcher catches the thread before the second thread catcher catches and pulls the thread; and a guide member disposed between the first thread catcher and the driving assembly, wherein the guide member is configured to guide the first thread catcher from an advanced position to a thread catching position at which the first thread catcher catches the thread, and to further guide the first thread catcher from the thread catching position to a standby position to turn the first thread catcher toward the fixed blade.

2. The thread cutting device according to claim 1, wherein the first thread catcher comprises:

a support portion; and a catching portion which catches the thread, wherein the guide member is formed with a guide slot into which the support portion is inserted, and wherein the guide slot comprises:

a first guide portion which guides the first thread catcher from the advanced position to the thread catching position; and a second guide portion which extends from the first guide portion in a direction away from the second thread catcher to guide the first thread catcher from the thread catching position to the standby position.

3. A thread cutting device of a sewing machine, the sewing machine comprising a needle which moves up and down, a throat plate formed with a needle hole through which the needle passes, and a horizontal shuttle which rotates below the throat plate to form a stitch in cooperation with the needle, wherein the thread cutting device cuts a thread extending between the horizontal shuttle and the needle hole, the thread cutting device comprising:

cutting means for cutting the thread;

first thread catching means for catching the thread;

second thread catching means for catching the thread and for pulling the thread toward the cutting means to cut the thread;

driving means for moving the first thread catching means and the second thread catching means such that the first thread catching means catches the thread before the second thread catching means catches and pulls the thread; and guiding means for guiding the first thread catching means from an advanced position to a thread catching position at which the first thread catching means catches the thread, and for further guiding the first thread catching means from the thread catching position to a standby position to turn the first thread catching means toward the cutting means.

* * * * *